US012600537B2

(12) United States Patent
Wisniewski et al.

(10) Patent No.: US 12,600,537 B2
(45) Date of Patent: Apr. 14, 2026

(54) DISPENSING CLOSURE

(71) Applicant: AptarGroup, Inc., Crystal Lake, IL (US)

(72) Inventors: John Wisniewski, Wauwatosa, WI (US); Timothy Michael Mazurkiewicz, Waukesha, WI (US); Christopher Branca, Charlotte, NC (US); Stacy L. Beilke, East Troy, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 18/701,845

(22) PCT Filed: Oct. 18, 2022

(86) PCT No.: PCT/US2022/046949
§ 371 (c)(1),
(2) Date: Apr. 16, 2024

(87) PCT Pub. No.: WO2023/069387
PCT Pub. Date: Apr. 27, 2023

(65) Prior Publication Data

US 2024/0417143 A1 Dec. 19, 2024

Related U.S. Application Data

(60) Provisional application No. 63/270,374, filed on Oct. 21, 2021.

(51) Int. Cl.
*B65D 47/08* (2006.01)
*B65D 47/10* (2006.01)
(Continued)

(52) U.S. Cl.
CPC ..... *B65D 47/0804* (2013.01); *B65D 47/103* (2013.01); *B65D 47/106* (2013.01)

(58) Field of Classification Search
CPC .... B65D 2251/0025; B65D 2251/0093; B65D 41/20; B65D 41/50; B65D 47/0804;
(Continued)

(56) References Cited

U.S. PATENT DOCUMENTS 882,287 A * 3/1908 Behr ..... B65D 47/0804 215/263
3,347,410 A * 10/1967 Schwartzman ..... B44D 3/06 222/129
(Continued)

FOREIGN PATENT DOCUMENTS

CH 446092 A 10/1967
EP 0788976 A1 * 8/1997 ..... B65D 47/0857
(Continued)

OTHER PUBLICATIONS

International Search Report and Written Opinion dated Mar. 31, 2023 for PCT/US2022/046949, of which this is the U.S. national phase application.

*Primary Examiner* — Anthony D Stashick
*Assistant Examiner* — Marcos Javier Rodriguez Molina
(74) *Attorney, Agent, or Firm* — Wood, Phillips, Katz, Clark & Mortimer

(57) ABSTRACT

A dispensing closure (40, 40A, 40B) includes a first body (54, 54A, 54B) for being located at an opening of a container (44, 44A, 44B) and having a first peripheral wall (56, 56A, 56B) and a membrane (60, 60A, 60B) that is integrally molded with the first peripheral wall (56, 56A, 56N) to initially occlude access to the interior of the container (44, 44A, 44B). The closure (40, 40A, 40B) includes a second body (55, 55A, 55B) for surrounding at least a portion of the first body (54, 55A, 55B) and defining a dispensing orifice (88, 88A, 88B). Either the first body (54, 54A, 54B) and/or the second body (55, 55A, 55B) includes means for accommodating engagement by a user to breach only a portion of
(Continued)

the membrane (60, 60A, 60B) in a direction toward the interior of the container (44, 44A, 44B) to permit access to the interior of the container (44, 44A, 44B).

23 Claims, 40 Drawing Sheets

(51) Int. Cl.
*B65D 47/36* (2006.01)
*B65D 51/22* (2006.01)

(58) Field of Classification Search
CPC .... B65D 47/103; B65D 47/106; B65D 47/36; B65D 51/18; B65D 51/224; B65D 1/00; B65D 1/02; B65D 1/0207; B65D 1/0215; B65D 1/0223; B65D 1/023; B65D 1/0238; B65D 1/0246; B65D 1/0253; B65D 1/0261; B65D 1/0292; B65D 1/04; B65D 1/06; B65D 1/095; B65D 1/12; B65D 1/14; B65D 1/16; B65D 1/165; B65D 1/22; B65D 1/26; B65D 1/265; B65D 1/30; B65D 1/32; B65D 1/36; B65D 1/40; B65D 1/42; B65D 11/02; B65D 11/04; B65D 11/08; B65D 11/10; B65D 11/18; B65D 15/02; B65D 15/06; B65D 15/08; B65D 15/14; B65D 15/18; B65D 15/22; B65D 15/24; B65D 17/00; B65D 17/02; B65D 17/04; B65D 17/08; B65D 17/28; B65D 17/32; B65D 17/34; B65D 17/347; B65D 17/353; B65D 17/38; B65D 17/401; B65D 17/4011; B65D 17/4012; B65D 17/4014; B65D 17/402; B65D 17/404; B65D 17/42; B65D 17/44; B65D 17/46; B65D 17/462; B65D 17/50; B65D 17/501; B65D 17/502; B65D 17/503; B65D 17/505; B65D 17/506; B65D 17/507; B65D 17/521; B65D 21/0204; B65D 21/0206; B65D 21/0209; B65D 21/0219; B65D 21/022; B65D 21/0231; B65D 21/0233; B65D 21/0238; B65D 21/086; B65D 2101/0023; B65D 2203/00; B65D 2203/02; B65D 2203/04; B65D 2203/06; B65D 2203/10; B65D 2203/12; B65D 2205/00; B65D 2205/02; B65D 2205/025; B65D 2207/00; B65D 2209/00; B65D 2213/00; B65D 2215/00; B65D 2215/02; B65D 2215/04; B65D 2215/06; B65D 2215/08; B65D 2217/00; B65D 2217/02; B65D 2221/00; B65D 2231/001; B65D 2231/005; B65D 2231/007; B65D 2231/02; B65D 2231/022; B65D 2231/027; B65D 2251/0015; B65D 2251/0018; B65D 2251/0021; B65D 2251/0028; B65D 2251/0031; B65D 2251/0053; B65D 2251/0056; B65D 2251/0062; B65D 2251/0071; B65D 2251/0075; B65D 2251/0078; B65D 2251/0081; B65D 2251/0087; B65D 2251/009; B65D 2251/0096; B65D 2251/01; B65D 2251/02; B65D 2251/023; B65D 2251/026; B65D 2251/04; B65D 2251/08; B65D 2251/09; B65D 2251/10; B65D 2251/1008; B65D 2251/1016; B65D 2251/1025; B65D 2251/1041; B65D 2251/105; B65D 2251/1058; B65D 2251/1066; B65D 2251/1075; B65D 2251/1083; B65D 2251/20; B65D 2251/205; B65D 2255/20; B65D 23/00; B65D 23/001; B65D 23/003; B65D 23/02; B65D 23/04; B65D 23/08; B65D 23/0814; B65D 23/085; B65D 23/0864; B65D 23/0871; B65D 23/0878; B65D 23/106; B65D 23/14; B65D 2301/10; B65D 2313/02; B65D 2313/08; B65D 2401/00; B65D 2401/05; B65D 2401/10; B65D 2401/15; B65D 2401/20; B65D 2401/25; B65D 2401/30; B65D 2401/35; B65D 2401/40; B65D 2401/45; B65D 2401/50; B65D 2401/55; B65D 2401/60; B65D 25/00; B65D 25/02; B65D 25/04; B65D 25/08; B65D 25/082; B65D 25/087; B65D 25/10; B65D 25/14; B65D 25/16; B65D 25/20; B65D 25/205; B65D 25/22; B65D 25/24; B65D 25/28; B65D 25/2897; B65D 25/30; B65D 25/32; B65D 25/36; B65D 25/38; B65D 25/40; B65D 25/42; B65D 25/48; B65D 25/50; B65D 25/52; B65D 25/54; B65D 25/56; B65D 2501/0054; B65D 2501/0081; B65D 2517/0002; B65D 2517/0004; B65D 2517/0005; B65D 2517/0007; B65D 2517/0008; B65D 2517/0011; B65D 2517/0013; B65D 2517/0014; B65D 2517/0016; B65D 2517/0017; B65D 2517/002; B65D 2517/0022; B65D 2517/0028; B65D 2517/0034; B65D 2517/004; B65D 2517/0041; B65D 2517/0046; B65D 2517/0049; B65D 2517/0056; B65D 2517/0061; B65D 2517/0065; B65D 2517/0068; B65D 2517/0073; B65D 2517/0074; B65D 2517/0079; B65D 2517/0082; B65D 2517/0088; B65D 2517/0089; B65D 2517/0094; B65D 2517/0097; B65D 2517/5013; B65D 2517/5027; B65D 2517/5032; B65D 2517/5035; B65D 2517/5048; B65D 2517/5054; B65D 2517/5064; B65D 2517/5075; B65D 2517/5081; B65D 2517/5083; B65D 2517/5097; B65D 2519/00333; B65D 2519/00027; B65D 2543/00037; B65D 2543/00083; B65D 2543/00092; B65D 2543/0012; B65D 2543/00148; B65D 2543/00203; B65D 2543/00231; B65D 2543/00268; B65D 2543/00277; B65D 2543/00314; B65D 2543/00324; B65D 2543/00342; B65D 2543/00351; B65D 2543/00407; B65D 2543/00416; B65D 2543/00435; B65D 2543/00453; B65D 2543/0049; B65D 2543/005; B65D 2543/00518; B65D 2543/00527; B65D 2543/00555; B65D 2543/00574; B65D 2543/00629; B65D 2543/00638; B65D 2543/00685; B65D 2543/00694; B65D 2543/0074; B65D 2543/0075; B65D 2543/00796; B65D 2543/00805; B65D 2543/00833; B65D 2543/00842; B65D 2543/00907; B65D 2543/00944; B65D 2543/0099; B65D 2547/06; B65D 2555/025; B65D 2571/00018; B65D 2571/00135; B65D 2571/00148; B65D 2571/00154; B65D 2571/00283; B65D 2571/0029; B65D 2571/00388; B65D 2571/00401; B65D 2571/00487; B65D 2571/00493; B65D 2571/00543; B65D 2571/00549; B65D 2571/00574; B65D 2571/0058; B65D 2571/00604; B65D 2571/00611; B65D 2571/0066; B65D 2571/00666; B65D 2571/00728; B65D 2571/00753; B65D 2571/0079; B65D 2571/00796; B65D 2571/00882; B65D 2575/3218; B65D 2575/3227; B65D 2575/3236; B65D 2575/3245; B65D 2575/3254; B65D 2575/3281; B65D 2575/362; B65D 2575/365; B65D 2575/367; B65D 2575/368; B65D 2575/565; B65D 2575/58; B65D 2575/583; B65D 2575/586; B65D 2577/2025; B65D 2577/2033; B65D 2577/205; B65D 2577/2058; B65D 2577/2066; B65D 2577/2075; B65D 2577/2083; B65D 2577/2091; B65D 2581/055; B65D 2581/3406; B65D 2581/3408; B65D 2581/3421; B65D 2581/3422; B65D 2581/3424; B65D 2581/3428; B65D 2581/3429; B65D 2581/3431; B65D 2581/3435; B65D 2581/3436; B65D 2581/345; B65D 2581/346; B65D 2581/3472; B65D 2581/3498; B65D 2583/005; B65D 2583/0404; B65D 2583/0409; B65D 2583/0459; B65D 2583/0463; B65D 2583/049; B65D 2585/366; B65D 2585/56; B65D 2585/646; B65D 2585/647; B65D 2585/6835; B65D 2585/86; B65D 2585/88; B65D 2590/0066; B65D 2590/046; B65D 27/00; B65D 27/04; B65D 27/38; B65D 29/00; B65D 3/02; B65D 3/04; B65D 3/06; B65D 3/12; B65D 3/14; B65D 3/20; B65D 3/22; B65D 3/26; B65D 3/261; B65D 3/262; B65D 3/263; B65D 3/266; B65D 3/268; B65D 31/02; B65D 31/04; B65D 31/12; B65D 33/00; B65D 33/001; B65D 33/002; B65D 33/007; B65D 33/01; B65D 33/02; B65D 33/06; B65D 33/065; B65D 33/08; B65D 33/14; B65D 33/16; B65D 33/1608; B65D 33/18; B65D 33/20; B65D 33/2508; B65D 33/2516; B65D 33/2533; B65D 33/2541; B65D 33/30; B65D 33/34; B65D 35/02; B65D 35/08; B65D 35/10; B65D 35/12; B65D 35/14; B65D 35/22; B65D 35/24; B65D 35/242; B65D 35/28; B65D 35/285; B65D 35/30; B65D 35/32; B65D 35/36; B65D 35/38; B65D 35/44; B65D 35/56; B65D 37/00; B65D 39/00; B65D 39/0076; B65D 39/04; B65D 39/08; B65D 39/084; B65D 39/12; B65D 39/16; B65D 41/02; B65D 41/04; B65D 41/0407; B65D 41/0414; B65D 41/0421; B65D 41/0428; B65D 41/045; B65D 41/0485; B65D 41/0492; B65D 41/08; B65D 41/165; B65D 41/17; B65D 41/22; B65D 41/265; B65D 41/32; B65D 41/325; B65D 41/34; B65D 41/3404; B65D 41/3409; B65D 41/3414; B65D 41/3423; B65D 41/3428; B65D 41/3433; B65D 41/3438; B65D 41/3442; B65D 41/3447; B65D 41/348; B65D 41/365; B65D 41/42; B65D 41/44; B65D 41/46; B65D 41/47; B65D 41/48; B65D 41/485; B65D 41/52; B65D 41/565; B65D 41/58; B65D 41/62; B65D 43/02; B65D 43/0206; B65D 43/0208; B65D 43/021; B65D 43/0212; B65D 43/0218; B65D 43/022; B65D 43/0222; B65D 43/0225; B65D 43/0229; B65D 43/0231; B65D 43/0235; B65D 43/0237; B65D 43/0239; B65D 43/0249; B65D 43/0252; B65D 43/0254; B65D 43/0256; B65D 43/0258; B65D 43/026; B65D 43/0268; B65D 43/0289; B65D 43/0291; B65D 43/0297; B65D 43/06; B65D 43/14; B65D 43/16; B65D 43/161; B65D 43/162; B65D 43/163; B65D 43/164; B65D 43/165; B65D 43/169; B65D 43/18; A47J 31/3623; B01L 3/523; B29C 45/0081; B29L 2031/565; G09F 9/301; G09F 9/33; H05K 5/0217; H05K 5/03

USPC .... 215/10, 11.1, 11.2, 11.3, 11.4, 11.5, 11.6, 215/12.1, 12.2, 2, 200, 201, 202, 203, 215/204, 206, 208, 209, 211, 213, 215, 215/216, 217, 218, 219, 220, 221, 222, 215/223, 224, 225, 226, 227, 228, 229, 215/230, 231, 232, 233, 234, 235, 236, 215/237, 238, 241, 245, 246, 247, 248, 215/249, 250, 251, 252, 253, 254, 255, 215/256, 257, 258, 260, 262, 263, 270, 215/271, 272, 273, 274, 275, 276, 277, 215/278, 288, 291, 295, 296, 297, 301, 215/302, 303, 304, 305, 306, 307, 309, 215/310, 311, 314, 316, 317, 318, 319, 215/320, 321, 322, 324, 329, 330, 331, 215/332, 335, 337, 340, 341, 343, 344, 215/345, 346, 347, 348, 349, 350, 352, 215/353, 354, 355, 356, 360, 364, 365, 215/370, 373, 374, 376, 377, 379, 380, 215/381, 382, 383, 384, 385, 386, 387, 215/388, 389, 391, 396, 398, 399, 4, 40, 215/400, 42, 43, 44, 45, 46, 47, 48, 49, 215/50, 6, 900, 901, 902, DIG. 1, DIG. 2, 215/DIG. 3, DIG. 5, DIG. 6, DIG. 7, 215/DIG. 8; 18/701, 845; 141/1, 10, 141/100, 104, 108, 11, 110, 112, 114, 12, 141/17, 18, 19, 2, 22, 23, 231, 237, 25, 141/301, 309, 311 R, 312, 314, 316, 317, 141/319, 322, 329, 330, 331, 332, 335, 141/338, 34, 344, 346, 348, 349, 351, 141/355, 362, 363, 364, 366, 367, 375, 141/386, 390, 5, 61, 65, 67, 69, 7, 71, 8, 141/82, 83, 85, 94, 98; 206/0.5, 0.7, 206/0.82, 1.5, 139, 141, 147, 150, 155, 206/158, 180, 183, 191, 197, 204, 205, 206/213.1, 216, 217, 219, 220, 221, 222, 206/223, 225, 227, 228, 229, 231, 232, 206/233, 234, 236, 242, 245, 247, 254, 206/255, 259, 264, 267, 268, 273, 274, 206/278, 295, 3, 306, 314, 320, 338, 339,

206/340, 344, 349, 353, 362, 363, 364, 206/365, 366, 369, 37, 370, 38, 382, 389, 206/39, 390, 391, 395, 396, 408, 409, 206/411, 423, 424, 425, 427, 432, 434, 206/438, 439, 440, 443, 446, 447, 449, 206/45.25, 455, 457, 459.1, 459.5, 461, 206/462, 466, 467, 469, 470, 471, 476, 206/477, 484, 484.2, 485, 486, 494, 495, 206/497, 499, 5, 505, 508, 509, 519, 520, 206/521, 522, 523, 524, 524.1, 524.2, 206/524.6, 524.7, 525, 526, 528, 530, 206/531, 532, 534, 535, 536, 538, 539, 206/540, 544, 549, 551, 554, 557, 561, 206/564, 568, 569, 570, 571, 572, 579, 206/581, 582, 583, 586, 591, 593, 63.3, 206/63.5, 7.3, 722, 725, 736, 738, 746, 206/752, 758, 759, 762, 763, 773, 774, 206/775, 776, 779, 784, 804, 806, 807, 206/810, 811, 812, 813, 815, 820, 821, 206/824, 828, 831; 222/1, 102, 103, 105, 222/106, 107, 129, 129.1, 129.2, 129.3, 222/130, 133, 135, 136, 137, 144.5, 222/145.1, 145.5, 145.6, 146.1, 146.5, 222/146.6, 147, 153.01, 153.02, 153.05, 222/153.06, 153.07, 153.08, 153.1, 222/153.11, 153.13, 153.14, 156, 173, 222/175, 180, 181.1, 181.2, 182, 183, 222/185.1, 187, 188, 189.06, 189.09, 190, 222/192, 195, 205, 206, 207, 209, 211, 222/212, 213, 214, 215, 23, 254, 256, 222/259, 260, 3, 319, 321.1, 321.8, 321.9, 222/325, 326, 327, 333, 380, 382, 383.1, 222/384, 385, 386, 386.5, 387, 389, 39, 222/390, 391, 394, 396, 397, 399, 401, 222/402, 402.1, 402.11, 402.13, 402.24, 222/402.25, 41, 414, 416, 420, 451, 456, 222/461, 464.1, 464.2, 464.4, 464.5, 222/464.6, 464.7, 469, 478, 479, 48, 480, 222/481, 481.5, 482, 484, 490, 491, 494, 222/5, 504, 505, 506, 509, 510, 520, 521, 222/524, 525, 527, 528, 529, 530, 54, 222/541.1, 541.2, 541.3, 541.4, 541.5, 222/541.6, 541.9, 544, 545, 546, 548, 222/549, 555, 556, 559, 561, 562, 563, 222/564, 565, 566, 567, 569, 570, 571, 222/572, 573, 575, 591, 608, 626, 63, 222/630, 64, 78, 79, 80, 81, 82, 83, 83.5, 222/85, 86, 87, 88, 89, 90, 91, 92, 94, 95, 222/96, DIG. 1; 220/1.5, 1.6, 200, 202, 220/203.01, 203.06, 203.08, 203.24, 220/203.26, 203.28, 203.29, 210, 211, 220/212, 212.5, 213, 214, 216, 219, 221, 220/222, 227, 229, 23.2, 23.4, 23.6, 23.8, 220/23.83, 23.86, 23.87, 23.88, 23.89, 220/23.91, 230, 231, 233, 234, 239, 240, 220/241, 242, 243, 251, 253, 254.1, 220/254.2, 254.3, 254.4, 254.5, 254.6, 220/254.7, 254.8, 254.9, 255, 255.1, 220/256.1, 257.1, 257.2, 258.1, 258.2, 220/258.3, 258.4, 258.5, 59.1, 259.2, 220/259.3, 259.4, 259.5, 260, 261, 262, 220/263, 265, 266, 267, 268, 269, 270, 220/271, 272, 273, 274, 275, 276, 277, 220/278, 279, 280, 281, 283, 284, 285, 220/287, 288, 293, 294, 296, 298, 3.2, 220/3.3, 3.5, 3.6, 3.7, 3.8, 3.9, 3.92, 3.94, 220/300, 301, 303, 304, 305, 309.1, 314, 220/315, 319, 320, 323, 324, 326, 327, 220/345.1, 345.2, 345.3, 345.4, 348, 350, 220/351, 359.1, 359.2, 359.3, 359.4, 360, 220/361, 363, 364, 366.1, 367.1, 369, 37, 220/372, 373, 375, 376, 377, 378, 379, 220/380, 4.01, 4.02, 4.03, 4.12, 4.13, 220/4.14, 4.15, 4.16, 4.17, 4.21, 4.22, 220/4.23, 4.24, 4.25, 4.26, 4.27, 4.28, 220/4.29, 4.33, 476, 480, 482, 484, 220/495.01, 495.02, 495.03, 495.04, 220/495.05, 495.06, 495.07, 495.08, 220/495.1, 495.11, 500, 501, 502, 503, 220/505, 506, 507, 516, 520, 521, 522, 220/523, 524, 525, 526, 528, 529, 530, 220/532, 533, 553, 555, 557, 560.01, 220/560.02, 560.03, 560.15, 562, 563, 220/564, 565, 567.2, 568, 570, 571, 573, 220/573.1, 574, 574.1, 578, 581, 582, 220/586, 592.01, 592.05, 592.16, 592.17, 220/592.2, 592.25, 592.26, 592.27, 6, 220/600, 601, 604, 605, 606, 608, 609, 220/611, 612, 614, 615, 619, 62, 62.11, 220/62.12, 62.13, 62.15, 62.17, 62.19, 220/62.2, 62.21, 6.222, 620, 623, 624, 220/626, 628, 630, 633, 634, 639, 640, 220/642, 644, 645, 646, 648, 651, 652, 220/653, 657, 658, 659, 660, 661, 662, 220/666, 667, 669, 670, 671, 672, 673, 220/675, 676, 677, 678, 685, 691, 693, 220/694, 7, 700, 701, 703, 705, 707, 708, 220/709, 710, 710.5, 711, 712, 713, 714, 220/715, 716, 717, 718, 719, 720, 721, 220/723, 724, 725, 729, 730, 731, 733, 220/735, 737, 738, 739, 740, 744, 745, 220/746, 751, 754, 755, 756, 759, 760, 220/761, 767, 769, 770, 771, 772, 773, 220/780, 781, 782, 783, 784, 785, 786, 220/787, 788, 789, 790, 791, 792, 793, 220/794, 795, 796, 8, 801, 802, 805, 806, 220/810, 811, 812, 819, 821, 825, 826, 220/827, 830, 831, 832, 833, 834, 835, 220/836, 837, 838, 839, 840, 841, 842, 220/844, 845, 847, 849, 86.4, 86.2, 87.1, 220/88.1, 89.1, 89.2, 89.3, 89.4, 9.2, 9.4, 220/900, 901, 902, 903, 906, 908, 908.1, 220/908.3, 909, 912, 913, 915, 916, 917, 220/918, DIG. 11, DIG. 13, DIG. 19, 220/DIG. 27, DIG. 30, DIG. 31, DIG. 33, 220/DIG. 34, DIG. 6

See application file for complete search history.

(56) References Cited

U.S. PATENT DOCUMENTS

| | | | | |
|---|---|---|---|---|
| 5,505,326 | A | 4/1996 | Junko | |
| 5,992,668 | A | 11/1999 | Elliott | |
| 8,443,970 | B2 * | 5/2013 | Coon | B65D 51/2835 206/219 |
| 2004/0007587 | A1 | 1/2004 | Westphal | |
| 2007/0181522 | A1 | 8/2007 | Davidson | |
| 2008/0179331 | A1 * | 7/2008 | Sharp | B65D 51/2835 220/521 |
| 2012/0248133 | A1 | 10/2012 | Danks et al. | |

(56) References Cited

U.S. PATENT DOCUMENTS

| | | | | |
|---|---|---|---|---|
| 2014/0216958 | A1* | 8/2014 | Seelhofer | B65D 51/2835 206/219 |
| 2016/0347517 | A1 | 12/2016 | Ellenkamp-Van Olst et al. | |
| 2017/0050780 | A1* | 2/2017 | Danks | B65D 77/30 |

FOREIGN PATENT DOCUMENTS

| | | | | |
|---|---|---|---|---|
| EP | 1547934 | A1 * | 6/2005 | B65D 47/103 |
| EP | 2181932 | A1 | 5/2010 | |
| JP | 2011-173632 | A | 9/2011 | |
| JP | 2013-071762 | A | 4/2013 | |
| JP | 2020-164196 | A | 10/2020 | |
| NL | 1024665 | C2 | 5/2005 | |
| WO | 2000041868 | A1 | 7/2000 | |
| WO | WO-2007137721 | A1 * | 12/2007 | B65D 47/0885 |
| WO | 2008044442 | A1 | 4/2008 | |
| WO | WO-2014026852 | A1 * | 2/2014 | B65D 51/2835 |
| WO | 2015009171 | A1 | 1/2015 | |
| WO | WO-2016096710 | A1 * | 6/2016 | B65D 51/2835 |
| WO | 2023014627 | A1 | 2/2023 | |

* cited by examiner

DISPENSING CLOSURE

PRIORITY

This application claims priority of U.S. Provisional Patent Application No. 63/270,374, filed Oct. 21, 2021, the entire contents of which is incorporated herein by reference.

TECHNICAL FIELD

The present invention relates generally to a dispensing closure for use with a container of a fluent substance.

BACKGROUND OF THE INVENTION

And

Technical Problems Posed by the Prior Art

Closures are employed to selectively prevent or permit communication of a substance between the interior and the exterior of a container (e.g., flexible pouch, rigid bottle, machine, dispensing equipment, containment system, etc.) through an opening in the container. Various fluent and non-fluent substances (including lotions, creams, food items, granules, liquids, powders, small articles, etc.) may be packaged in a container. A typical closure includes a (1) body (e.g., screw or snap-fit base, pouch fitment, structure, etc.) located at an opening to the container interior, and (2) a closing element (e.g., a lid, cover, overcap, etc.).

The closure body can typically be either (1) a separate structure that (a) can be attached at such a container opening, and (b) defines at least one access passage through the body for communicating through such a container opening with the interior of such a container, or (2) an integral structure that is a unitary portion of such a container and that defines at least one access passage through the integral structure such that the access passage functions as the opening, per se, to the container.

The closing element typically accommodates movement relative to the body access passage between (1) a closed position occluding the access passage, and (2) an open position at least partially exposing the access passage. Some closures may include additional elements (e.g., tamper-evident features, silicone valves, locking elements, seals, etc.).

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. The container with the closure mounted thereon, and the contents stored therein, may be characterized as a "package."

A dispensing closure may provide an initial hermetic seal and/or may provide an initial tamper-evidency for indicating to a user that the closure integrity has been compromised. One such type of closure includes a body having a discharge end defining at least part of the access passage (which could be, for example, a discharge flow passage) that is initially sealed closed with a separable membrane. The discharge end of the body may further be covered with a closing element that is a cap or lid that can be removed, or moved away, from the discharge end so as to "open" the discharge end and allow access to the separable membrane. Typically, a separation member, such as a pull tab or pull ring, extends from the membrane. The pull tab or ring projects above the membrane. The user initially grasps the pull tab or ring to pull the membrane so as to separate the membrane from the body discharge end at the access passage to establish communication between the exterior ambient environment and the interior of the container or other system to which the closure is mounted. A frangible connection or tear path defines the line of separation between the membrane and the remaining portion of the closure body. However, such a separable membrane may create additional waste that must be discarded by a user. Alternatively, some non-separable membranes are typically formed from a foil or metal liner that is sealed between a closure and a container, which need not be separately discarded, but which may render the closure and/or the container unsuitable for many recycling streams.

The inventors of the present invention have determined that it would be desirable to provide, at least for some applications, an improved dispensing closure that includes a frangible, but non-separable membrane located within a relatively smaller dispensing orifice that exhibits an improved visual appearance to a user.

The inventors of the present invention have also determined that it would be desirable to provide an improved dispensing closure with a frangible, but non-separable membrane exhibiting improved performance in breaking from the remainder of the closure body and/or exhibiting a decreased force required by a user to initiate the tear or separation of the membrane from the remainder of the closure body. Preferably, the non-separable membrane would be unitarily molded out of the same thermoplastic material as the remainder of the closure for improved recyclability.

The inventors of the present invention have also found that it would be desirable to provide, at least for some applications, an improved dispensing closure that can be manufactured and/or assembled at a relatively low cost, and can accommodate manufacture by means of efficient, high-speed, large-volume techniques, and that can facilitate the minimization of plastic part weight.

The inventors of the present invention have discovered how to provide such an improved dispensing closure that includes novel, advantageous features not heretofore taught or contemplated by the prior art, and which can accommodate designs having one or more of the above-discussed benefits or features.

SUMMARY OF THE INVENTION

According to broad aspects of one form of the present invention, a dispensing closure is provided for use in dispensing a substance that may be stored within an interior of a container. The closure includes a first body for being located at an opening of a container. The first body has a first peripheral wall and a membrane that is integrally molded with the first peripheral wall to initially occlude access to the interior of the container. The closure further includes a second body surrounding at least a portion of the first body and defining a dispensing orifice. The first body and/or the second body includes means for accommodating engagement by a user to breach only a portion of the membrane in a direction toward the interior of the container to permit access to the interior of the container.

In one form of the present invention, the means includes a push portion rotatably connected to the second body. The push portion defines a cantilevered end that is located above the membrane proximate to the first peripheral wall.

In another form of the present invention, the dispensing closure defines a central axis extending outwardly away from the interior of the container and extending inwardly toward the interior of the container. The second body further includes a pour lip extending laterally and axially outwardly around the dispensing orifice, and the push portion is recessed, located axially inwardly of the pour lip.

According to another form of the present invention, the push portion is located within the dispensing orifice of the second body.

In one form of the present invention, the push portion is connected to a transverse wall of the second body by a hinge, and the push portion extends axially outwardly of the transverse wall.

In another form of the present invention, the push portion includes at least one rib facing the membrane and located laterally between the cantilevered end and the hinge.

According to another form of the present invention, the dispensing closure defines a central axis extending outwardly away from an interior of the container and extending inwardly toward an interior of the container, and the membrane includes an annular peripheral portion which slopes axially outwardly along the central axis and the membrane includes a concave central portion that slopes axially inwardly from the annular peripheral portion toward the central axis.

In another form of the present invention, the means includes a push portion connected to the membrane. The first body includes at least one piercing rib extending from the first peripheral wall, whereby a pushing engagement of the push portion by a user forces the membrane against the at least one piercing rib to breach only a portion of the membrane adjacent the at least one piercing rib. Preferably, the first body of the closure includes a plurality of piercing ribs.

According to yet another form of the present invention, the least one piercing rib or ribs terminates in a pointed end that is located axially outwardly of the first peripheral wall.

According to another form of the present invention, the second body includes a pour lip extending laterally and axially outwardly around the dispensing orifice, and the push portion is located laterally adjacent to the pour lip. Preferably, the push portion is located within the dispensing orifice of the second body of the closure.

According to broad aspects of another form of the present invention, a dispensing closure is provided for use in dispensing a substance that may be stored within an interior of a container. The closure includes a first body for being located at an opening of a container. The first body has a first peripheral wall and a membrane that is integrally molded with the first peripheral wall to initially occlude access to the interior of the container. The closure further includes a second body surrounding at least a portion of the first body and defining a dispensing orifice and including a movable lid. The membrane and the lid include engagement means whereby initial opening of the lid by a user separates the membrane from the first body such that the membrane is retained in the lid of the second body. Preferably, the engagement means on the first body includes one or more ribs extending from the membrane, the rib or ribs each defining a flange for engaging a portion of the lid. Preferably, the engagement means on the second body includes one or more internal walls extending downwardly from the interior of the lid, the wall or walls each defining a flange for engaging a portion of the membrane.

In one preferred form of the present invention, the membrane defines a frangible connection that is circular.

In another preferred form of the present invention, the membrane defines a frangible connection that is boat-shaped, having tapered leading and trail ends.

In still another preferred form of the present invention, the membrane defines a frangible connection that undulated to permit tearing from any angular direction.

In one form of the present invention, the means includes at least one projecting post connected to the membrane and at least one abutment connected to the second body, whereby relative rotation between the first body and the second body forces the at least one projecting post against the at least one abutment to breach only a portion of the membrane in a direction toward the interior of the container.

According to one preferred form of the invention, the at least one projecting post has a V-shaped cross-section, when viewed in a plane perpendicular to the central axis of the closure. Preferably, the membrane includes a plurality of projecting posts, and the second body includes a plurality of abutments.

In yet another form of the present invention, the at least one projecting post connects to an arcuate frangible section of the membrane. In one form, the membrane includes a non-frangible central portion.

In another broad form of the invention, the first body includes a second peripheral wall connected to, and surrounding, the first peripheral wall. The first and second peripheral walls function to receive a portion of the container to secure the first body at the opening of the container.

According to another aspect of the present invention, the second body includes a top deck and a skirt which extends downwardly from the top deck for surrounding a portion of the container. The second body further includes a lid rotatably connected to the top deck.

In one form of the present invention, the second body includes means for being non-removably secured with the first body at an opening of the container. Preferably, the means include a flexible flange or snap-fit bead.

In still another form of the present invention, the dispensing closure, including the first and second bodies, is provided in combination with a container of a fluent substance, wherein the closure, container, and the fluent substance together define a package.

It should be appreciated that the invention may include any or all of the above-described features, include only one of the above-described features, more than one of the above-described features, and any combination of the above-described features. Furthermore, other objects, features and advantages of the invention will become apparent from a review of the entire specification including the appended claims and drawings.

BRIEF DESCRIPTION OF THE DRAWINGS

FIG. 1 shows the closure with the lid in a closed position;

FIG. 2 shows the lid of the closure in the open position;

FIG. 6 shows the push member of the closure in the unactuated position above the unopened membrane;

FIG. 8 shows the push member in an actuated position having pierced the membrane to permit flow of a fluent substance through the dispensing orifice of the closure;

FIG. 10 shows the shows the push member in an actuated position having pierced the membrane;

FIG. 1 shows the closure with the lid in a closed position;

FIG. 13 shows the lid of the closure in the open position;

FIG. 17 shows the push member of the closure in the unactuated position above the unopened membrane;

FIG. 19 shows the push member in an actuated position having pierced the membrane to permit flow of a fluent substance through the dispensing orifice of the closure;

FIG. 22 shows the closure with the lid in an open position;

FIG. 26 shows the closure in a moved position compared to FIG. 22 and rotated relative to the container and into an actuated position wherein the membrane has been breached to permit flow of a fluent substance through the dispensing orifice of the closure;

FIG. 33 shows the lid in an open position prior to initial movement of the lid into the closed position to engage a portion of the removable membrane;

FIG. 37 shows the lid moved into a closed position wherein the lid engages a portion of the frangible membrane;

FIG. 38 shows the lid moved into a partially open position wherein the lid has breached the connection of the membrane with the remainder of the first body;

FIG. 39 shows the lid moved into a fully open position whereby the membrane has been fully removed from the remainder of the first body and is retained in the lid;

DESCRIPTION OF THE PREFERRED EMBODIMENTS

Figure 1:
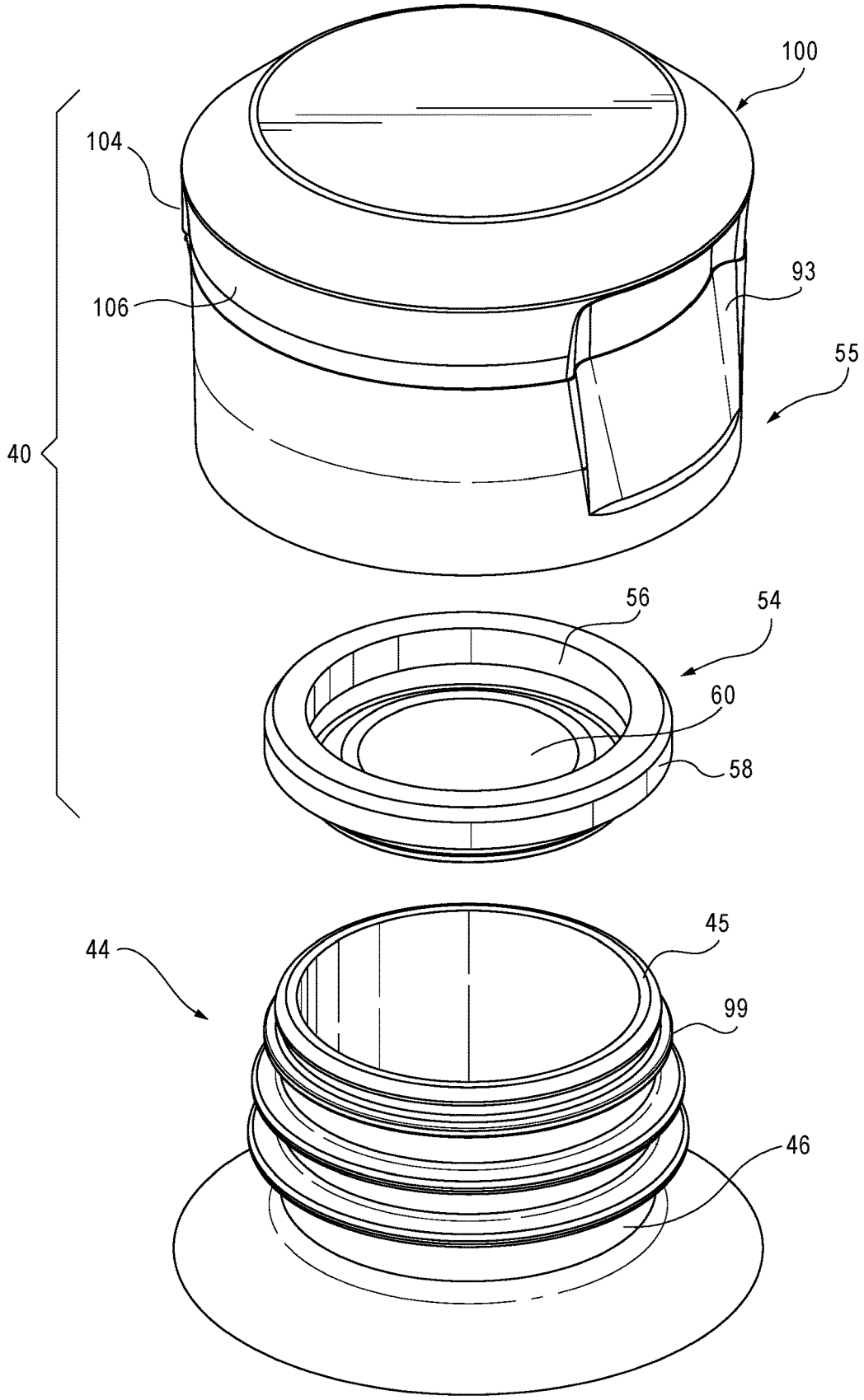
FIG. 1 is an exploded, isometric view, taken from the front and above, of a first embodiment of a dispensing closure according to the present invention installed on a fragmentary upper portion or neck of a container.
Figure 2:
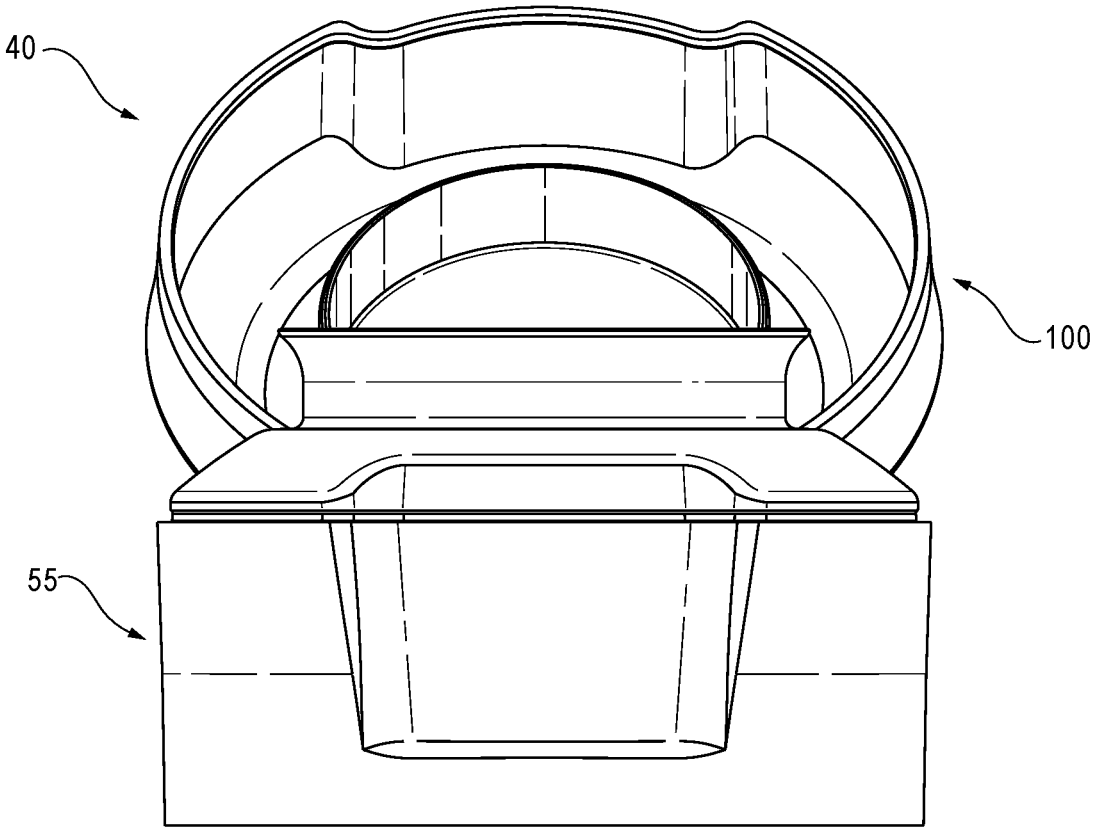
FIG. 2 is a front elevation view of only the dispensing closure of FIG. 1.
Figure 3:
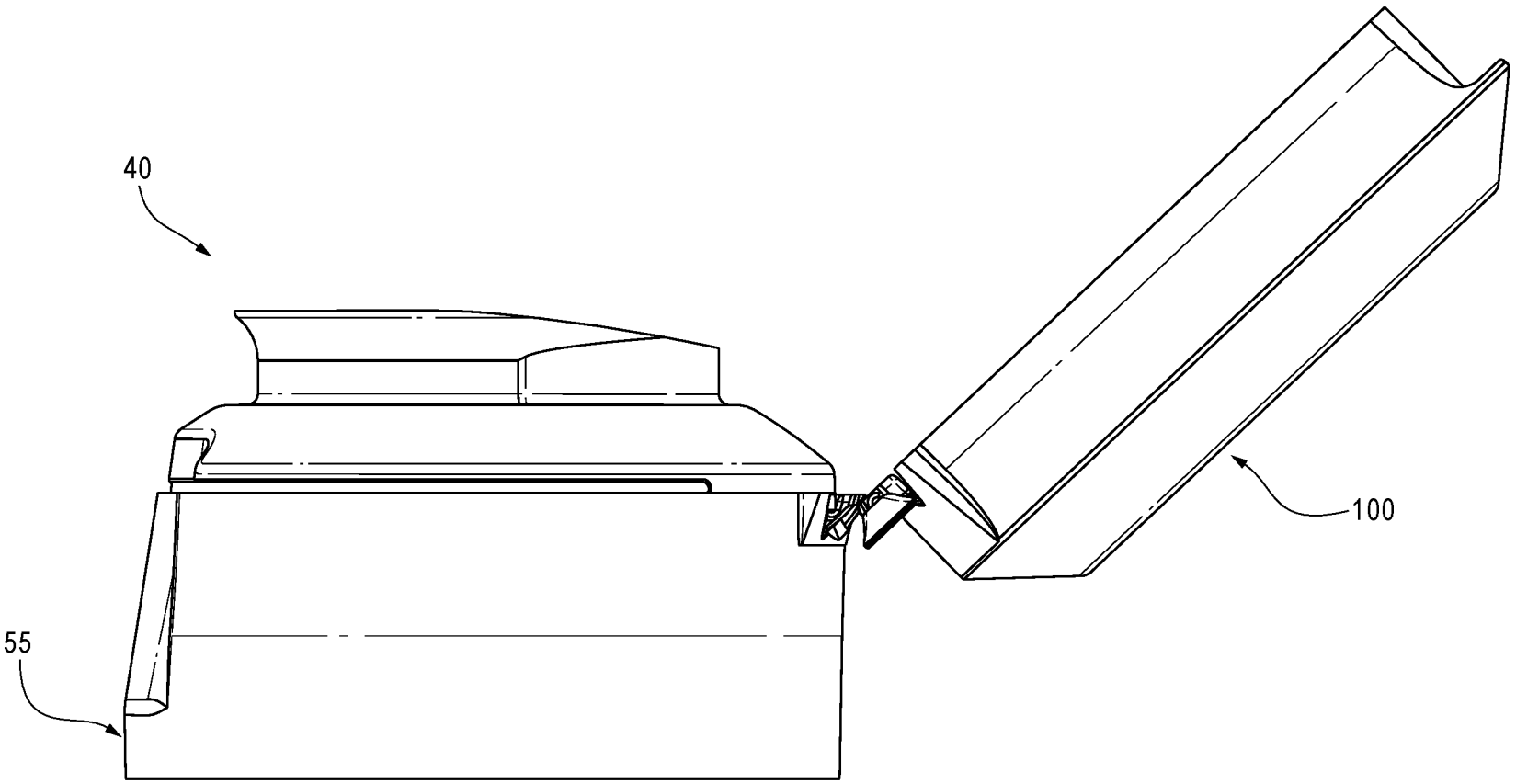
FIG. 3 is a right side elevation view of the dispensing closure of FIG. 2.
Figure 4:
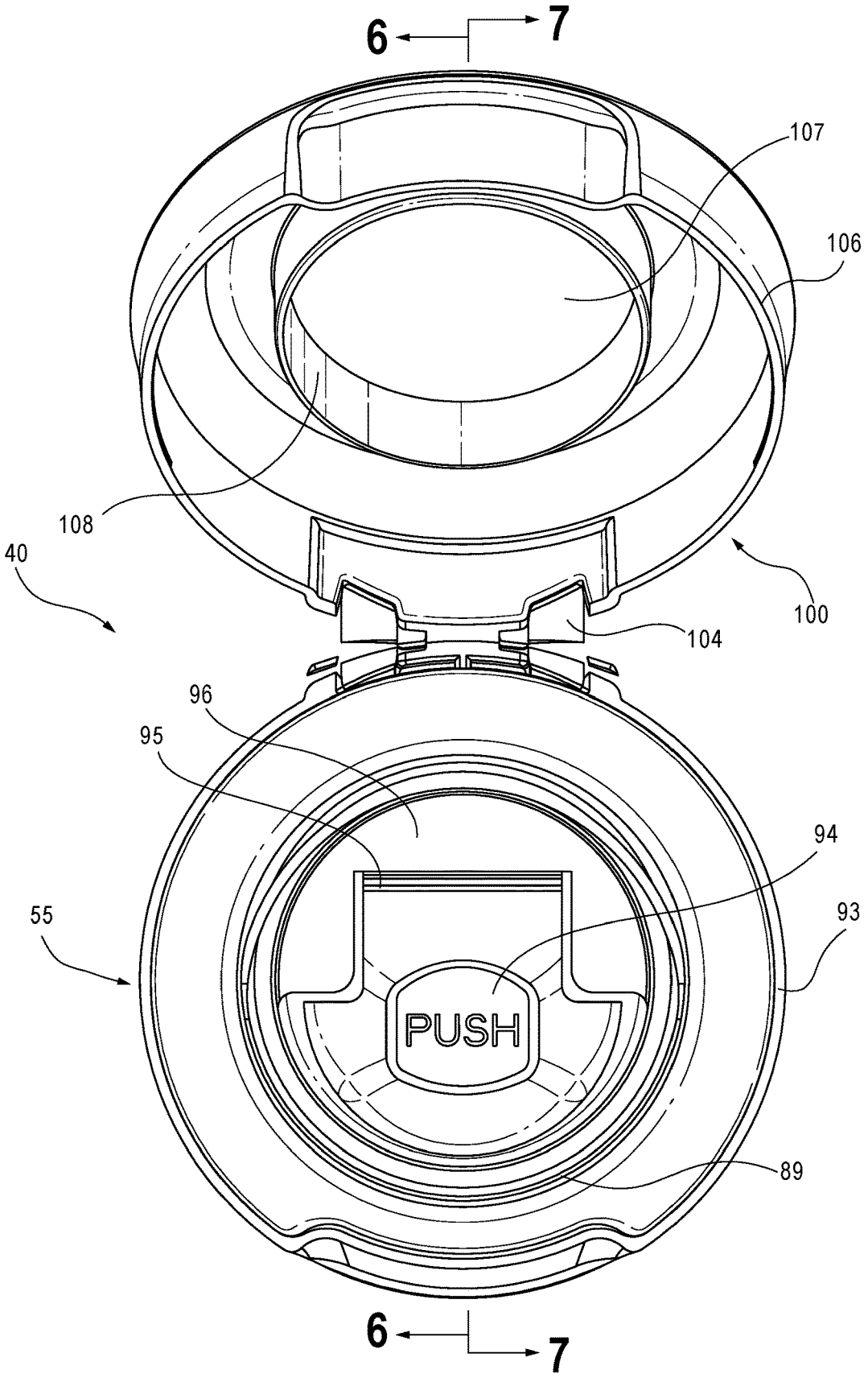
FIG. 4 is a top plan view of the dispensing closure of FIG. 2.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show embodiments of a dispensing closure (or simply referred to herein as a "closure") 40 in the typical orientation that the closure 40 would have when located (i.e., installed, attached, etc.) at the opening of a container 44 such as an upright bottle, and terms such as "inward", "outward", "upper", "lower", "axial", "radial", "lateral", etc., are used with reference to this orientation. The term "axially inward" is to be understood as in the direction along a central axis "A" extending vertically through the center of the membrane of the closure 40, toward the interior of the container 44 when the closure 40 is mounted atop the opening of the container 44 (downward in FIG. 1). The term "axially outward" is to be understood as in the opposite direction along the central axis "A", away from the interior of the container 44 (upward in FIG. 1). The term "radially inward" is to be understood as in the radial direction toward the central axis "A". The term "radially outward" is to be understood as in the radial direction away from the central axis "A". The term "laterally inward" is to be understood as in a direction toward the central axis "A", in a plane normal to the central axis "A". The term "laterally outward" is to be understood as in a direction away from the central axis "A", in a plane normal to the central axis "A". It will be understood, however, that the closure of this invention may be manufactured, stored, transported, used, and sold in an orientation other than the specific orientations described and illustrated herein.

The dispensing closure of this invention is especially suitable for use with a variety of conventional or special containers, the details of which, although not fully illustrated or described, would be apparent to those having skill in the art and an understanding of such containers. The particular container illustrated is not intended to limit the present invention. It will also be understood by those of ordinary skill that novel and non-obvious inventive aspects are embodied in the described closure alone.

The dispensing closure described herein is especially suitable for use in dispensing fluent substances. Such dispensed fluent substances may be, for example, food additives, a personal care product, an industrial product, a household product, or other types of products. Such substances may be for internal or external use by humans or animals, or for other uses (e.g., activities involving medicine, commercial or household maintenance, agriculture, manufacturing, etc.).

The first illustrated embodiment of the dispensing closure 40 of the present invention has the form of an assembly of parts or articles that are configured to be (i) selectively placed or installed at an opening of a container (such as the container 44 in FIGS. 1 and 10-11), (ii) only partially ruptured or breached to permit communication through a dispensing orifice, and (iii) actuated to dispense a fluent substance from the interior of the container through the exposed dispensing orifice. The illustrated container 44 has the form of a bottle that would typically contain the fluent substance. The fluent substance to be dispensed from the closure 40 is not illustrated in the figures because the substance may take a variety of forms. The closure 40 can be mounted to a container 44 with removable or non-removable means or features such as mating threads, snap-fit beads and grooves, toggle clamps, friction fittings, locks, adhesives, welding, non-removable flanges (as illustrated), etc.

It will be understood that the container 44 may be any conventional type, such as a collapsible, flexible pouch, or may be a generally rigid bottle that has somewhat flexible, resilient walls. The container 44, or a portion thereof, may be made from a material suitable for the intended application. For example, the container may be a pouch made from a thin, flexible material (wherein such a material could be a polyethylene terephthalate (PET) film or a polyethylene film and/or an aluminum foil). Alternatively, a more rigid container (e.g., a bottle) could be made from a thicker, less flexible material such as molded polyethylene, polypropylene, polyethylene terephthalate, polyvinylchloride, glass, metal, or other materials.

It is contemplated that typically, after the closure manufacturer would make the dispensing closure 40 (e.g., by molding its components from a thermoplastic polymer or polymers), the manufacturer will then ship the closure 40 to a filler facility at another location where the container 44 would be filled with a product, assembled with the closure 40, and sealed in the form of a package that would be encountered by a customer or user.

With reference to the accompanying FIG. 1, the first illustrated embodiment of the dispensing closure 40 includes the main components of (i) a fitment or first body 54 for being received within the opening of a container 44, and (ii) an overclosure or second body 55 for surrounding and covering at least a portion of the first body 54. As will be discussed in greater detail hereinafter, a membrane or sealing portion 60 of the first body 54 can be only partially breached in an axially inward direction (downward along central axis "A") by a user once the second body 55 has been opened to permit communication of a fluent substance from the interior of the container 44 through the opened closure 40.

Figure 11:
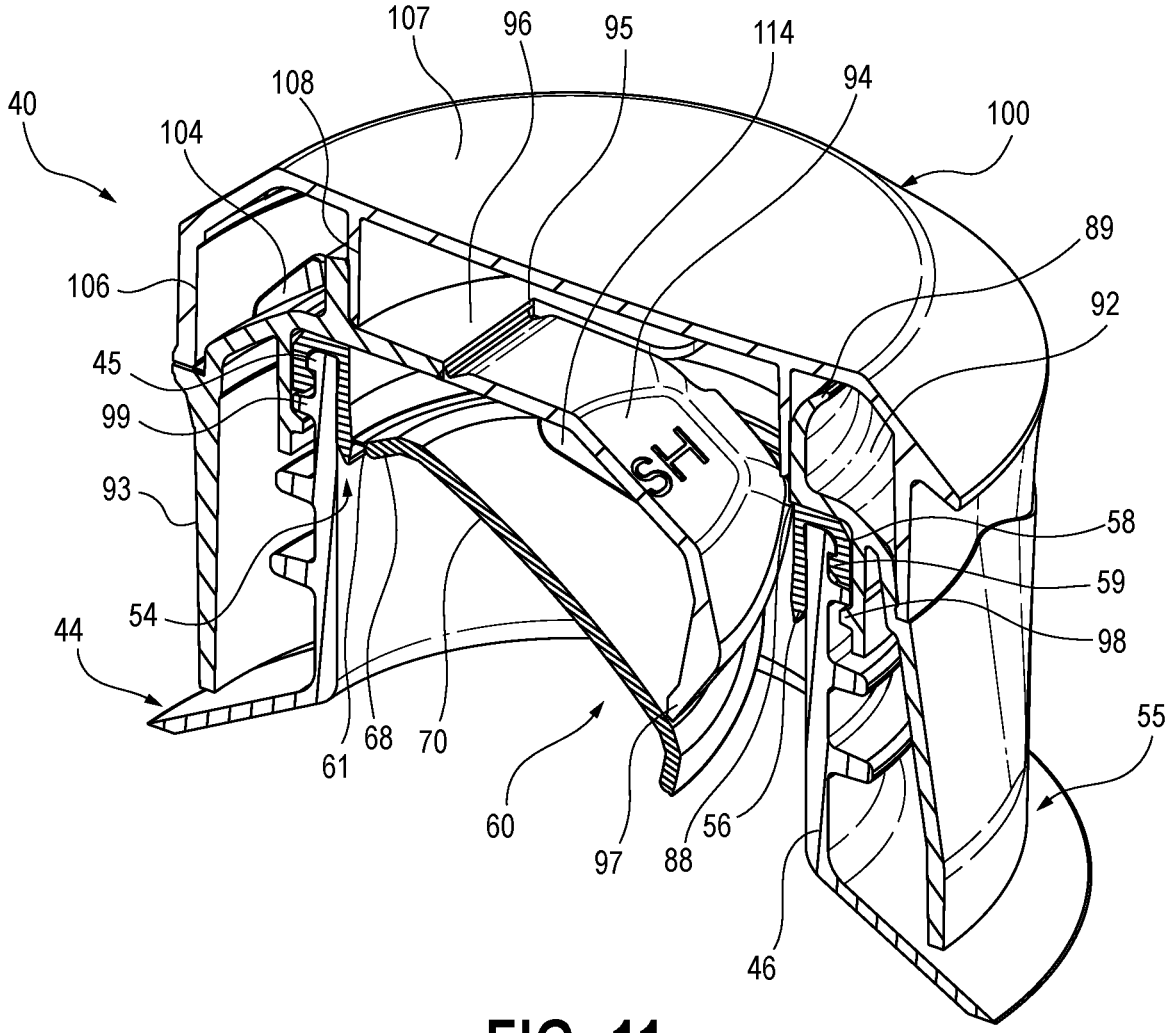
FIG. 11 is an isometric cross-sectional view of the dispensing closure and fragmentary portion of the container of FIG. 10.
Figure 12:
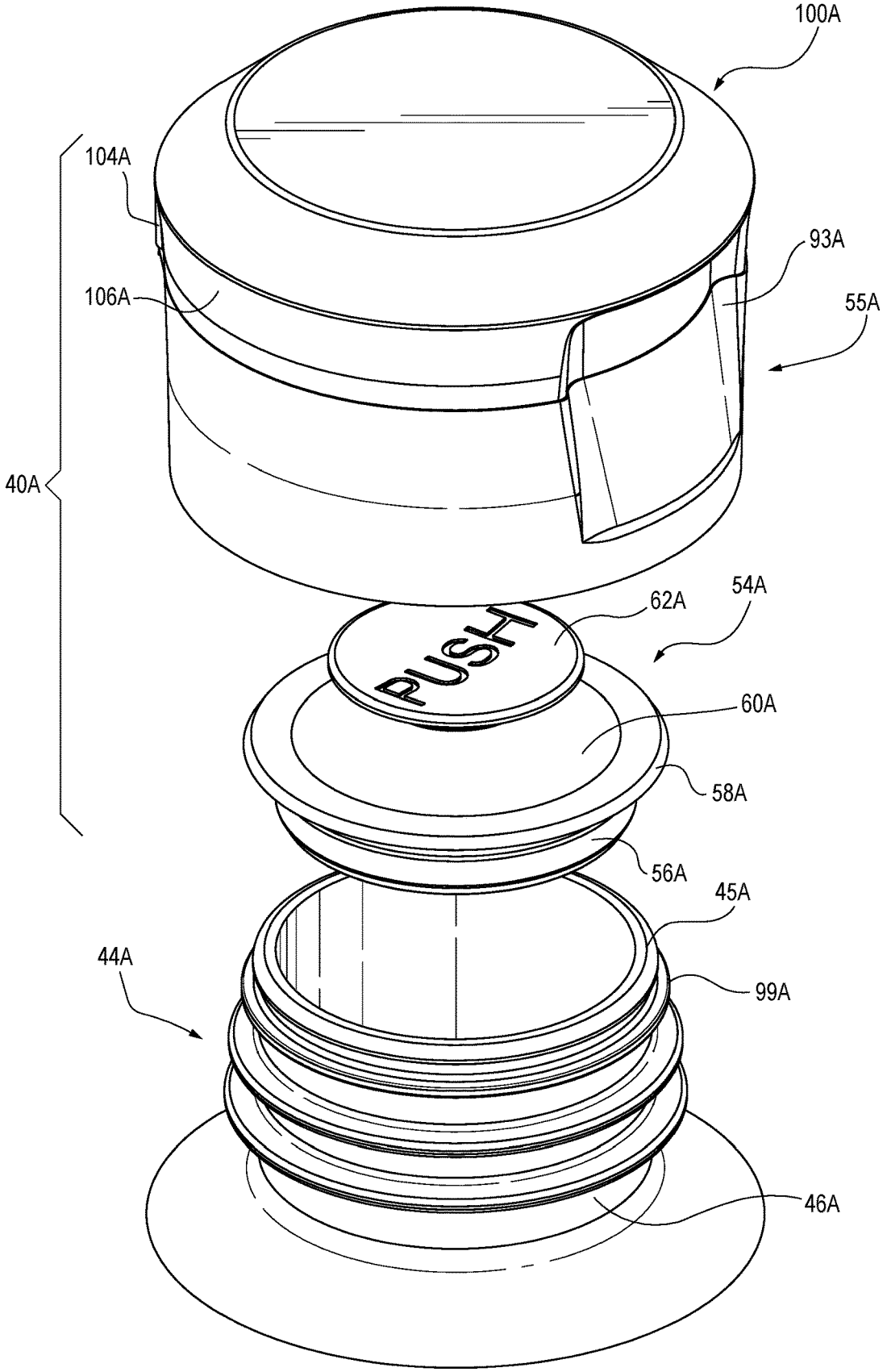
FIG. 12 is an exploded, isometric view, taken from the front and above, of a second embodiment of a dispensing closure according to the present invention installed on a fragmentary upper portion or neck of a container.
Figure 13:
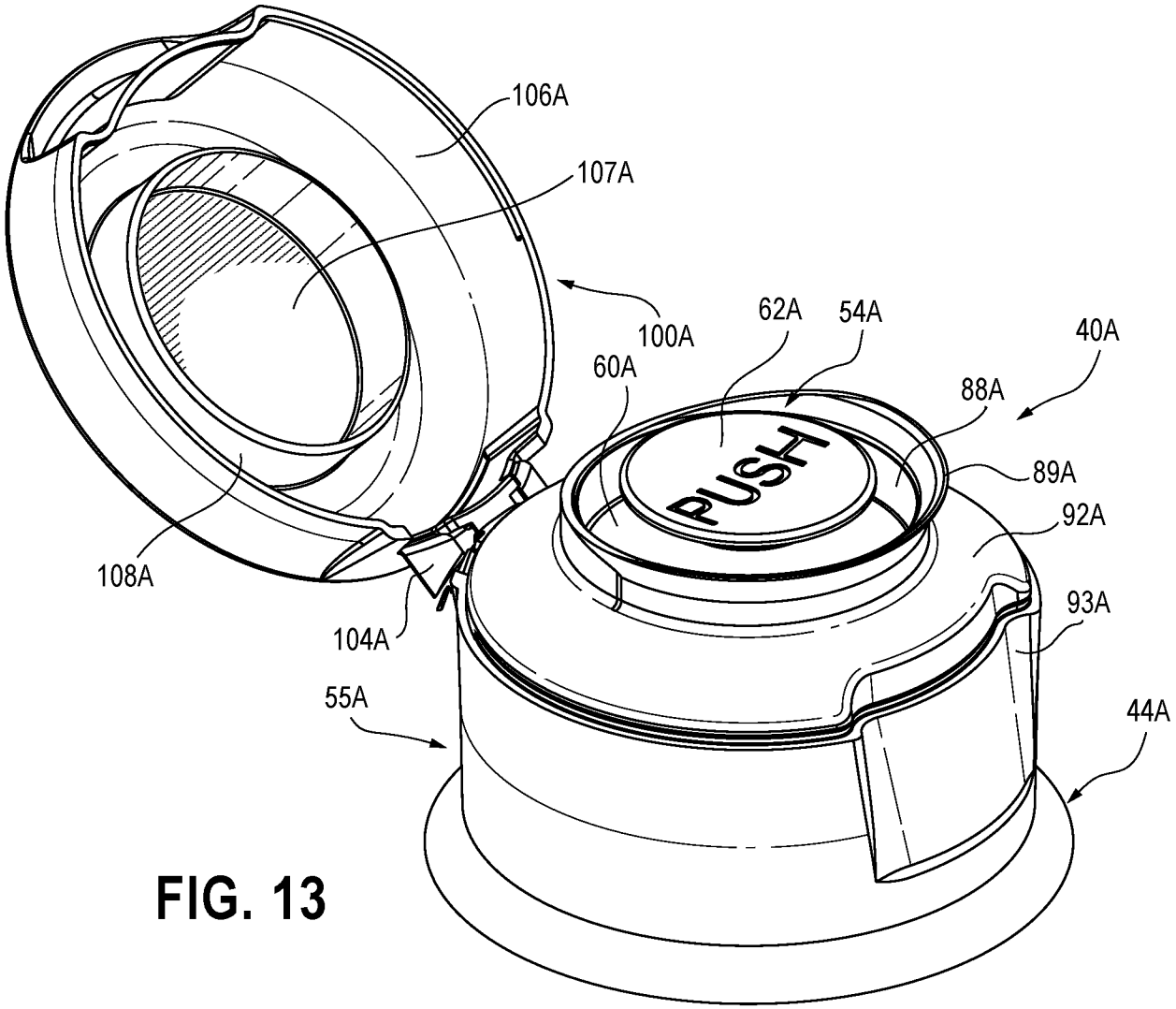
FIG. 13 is an isometric view, taken from the front and above, of the dispensing closure and the container of FIG. 12.
Figure 14:
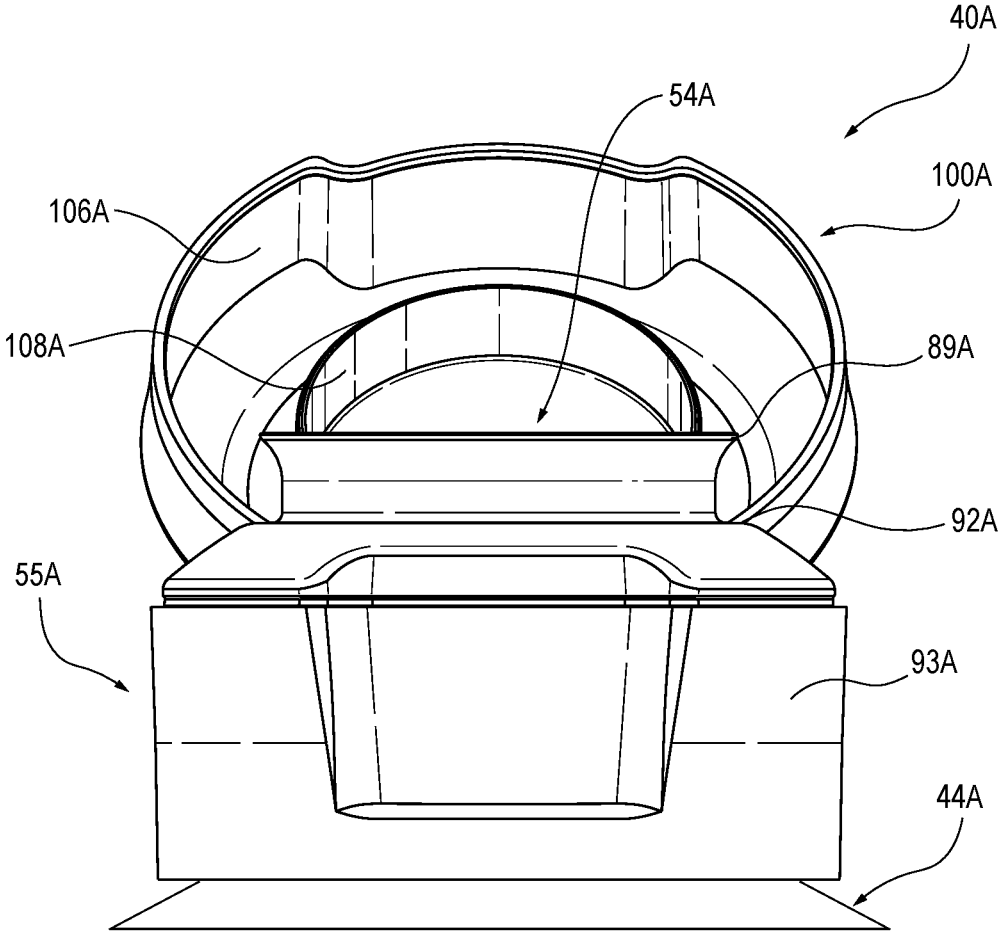
FIG. 14 is a front elevation view of the dispensing closure and the container of FIG. 13.
Figure 15:
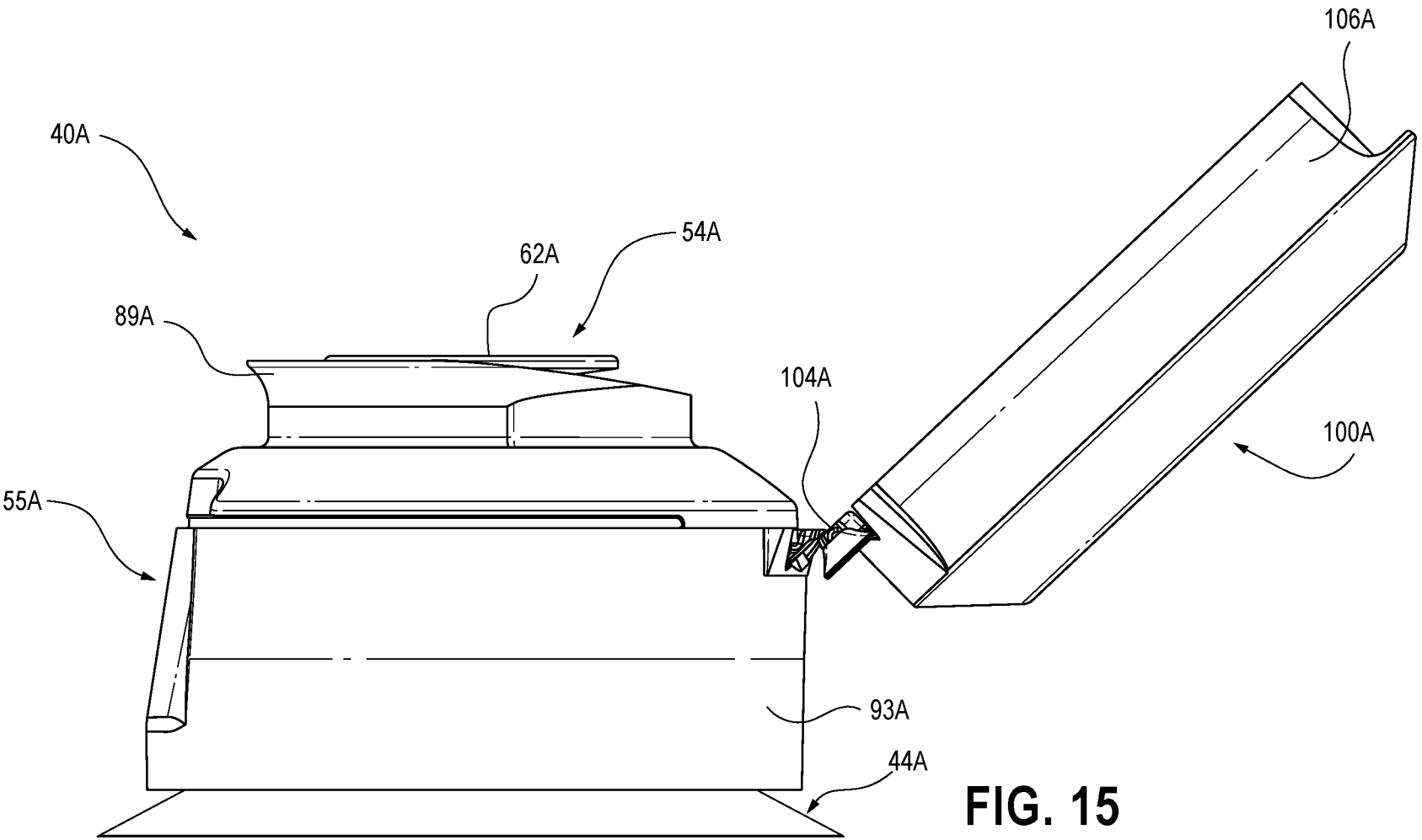
FIG. 15 is a right side elevation view of the dispensing closure and the container of FIG. 13.
Figure 16:
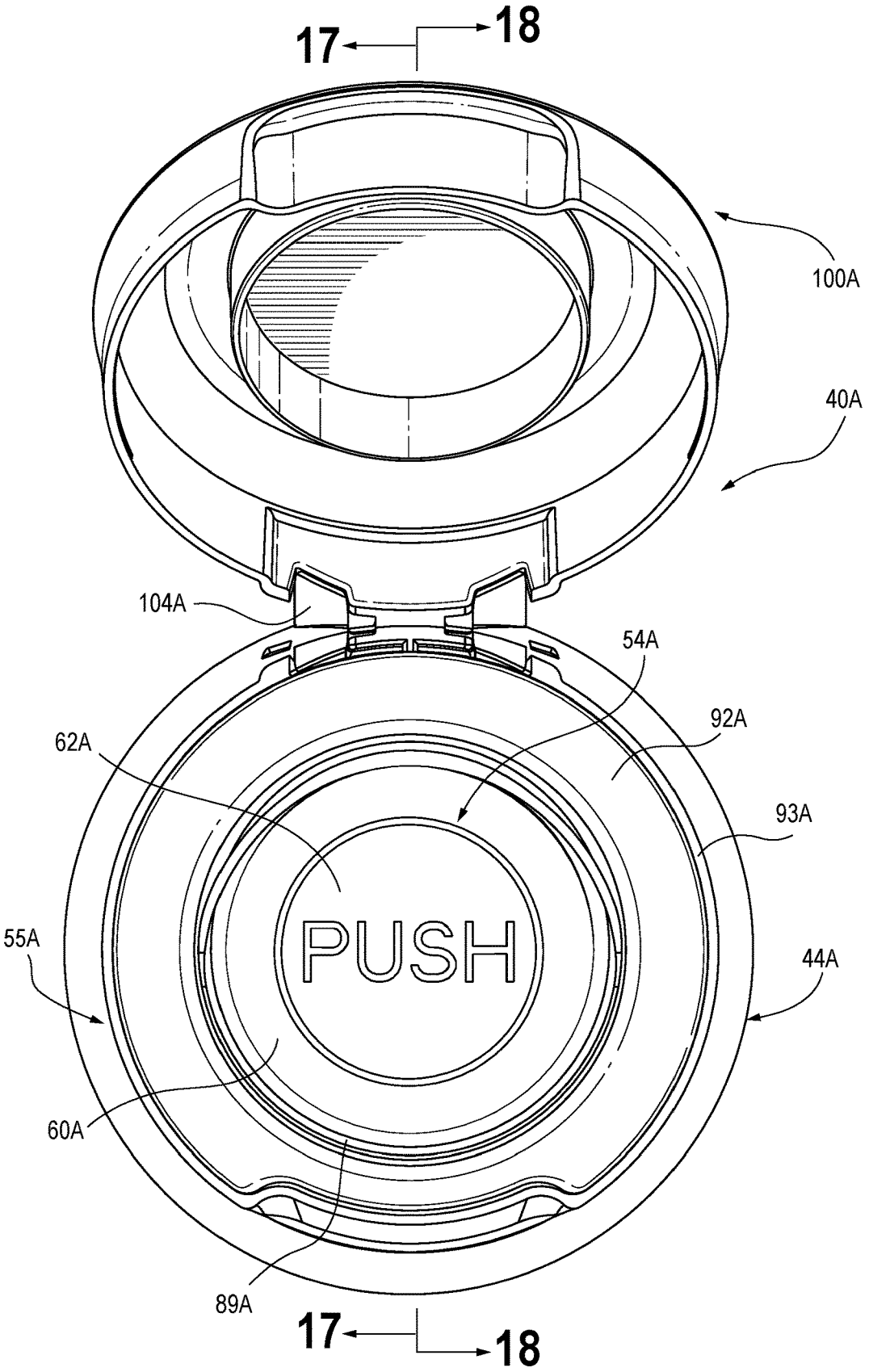
FIG. 16 is a top plan view of the dispensing closure and the container of FIG. 13.

Referring to FIGS. 1 and 11, the fitment or first body 54 of the closure 40 is cylindrical with a cuplike shape. The first body 54 includes an annular, plug wall or first peripheral wall 56 for being received within, and making sealing contact with, the opening of the container 44. The first body 54 further includes a second peripheral wall 58 that is connected to, and surrounds, the first peripheral wall 56. The first and second peripheral walls 56 and 58 define an annular recess therebetween for receiving a portion of the container 44 near the opening thereof. An attachment means in the form of a laterally-inwardly extending bead 59 (visible in FIG. 11) is located on the second peripheral wall 58 for mating with a laterally-outwardly extending bead 45 located on a neck portion 46 of the container 44. Other ordinary or special means of attaching the first body 54 with the container 44 may be used other than a bead 59, such as mating threads, flanges, adhesives, welding, ribs, friction fitting, etc.

Figure 6:
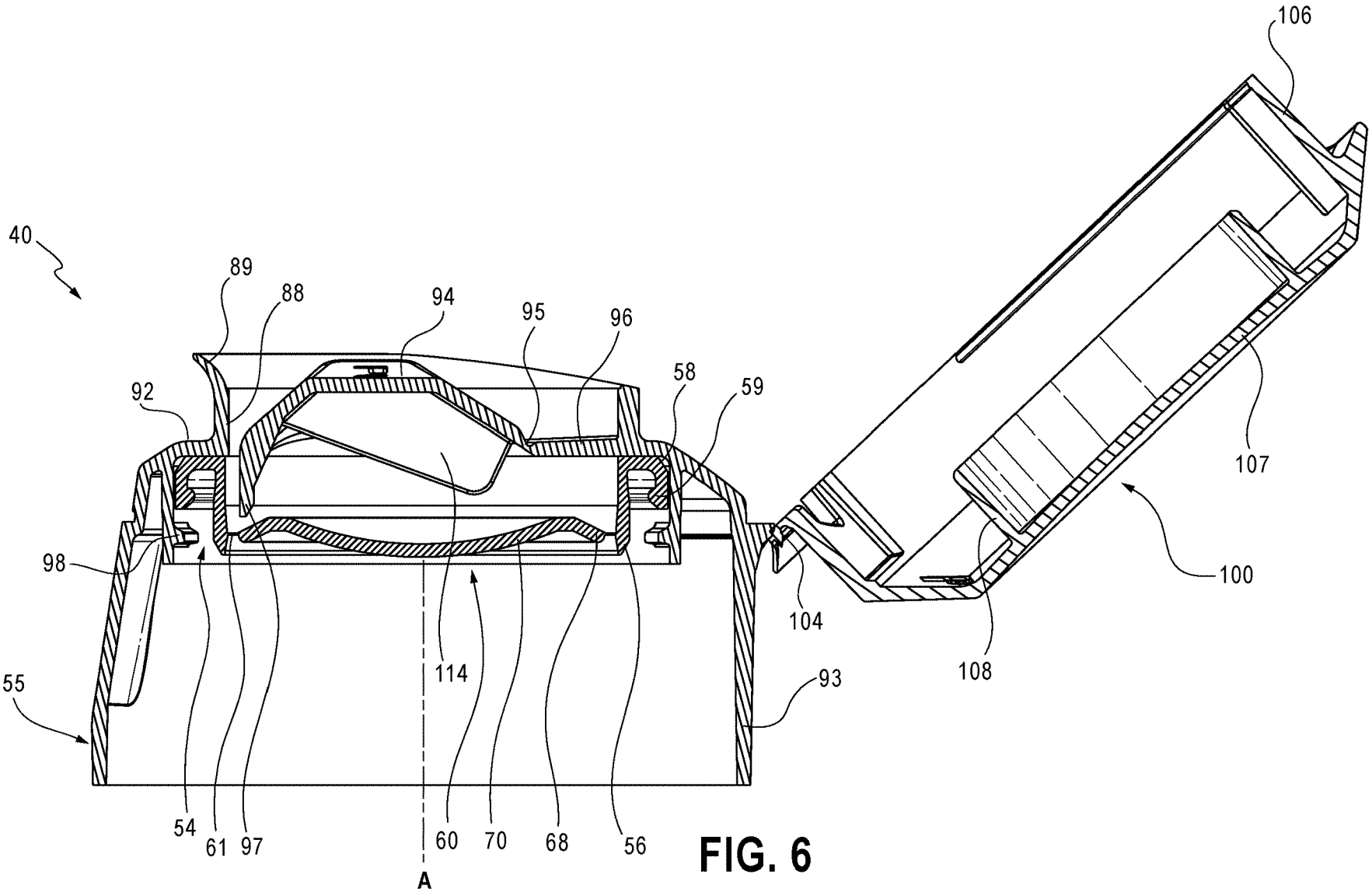
FIG. 6 is a cross-sectional view of the dispensing closure, taken along view plane 6-6 in FIG. 4.

With reference to FIG. 6, a sealing disc or membrane 60 is connected to the bottom end of the first peripheral wall 56 by a frangible or thinned material connection 61. The membrane 60 extends radially inwardly from the connection 61 to occlude the opening of the container 44 (not shown in FIG. 6) when the first body 54 is installed on the container 44.

As further illustrated in FIG. 6, the membrane 60 includes an annular peripheral portion 68 that is located adjacent to the first peripheral wall 56 and which slopes axially outwardly (away from the container interior) along the central axis "A" when moving in a radial direction moving away from the first peripheral wall 56 toward the central axis "A". The membrane 60 further includes a concave central portion 70 that slopes axially inwardly (toward the container interior) in the direction from the annular peripheral portion 68 toward the central axis "A".

It will be understood that while the membrane 60 in the illustrated, preferred embodiment of the closure 40 is generally disc shaped, the membrane 60 may have other non-circular shapes for occluding a non-circular opening defined by the wall 56.

Figure 5:
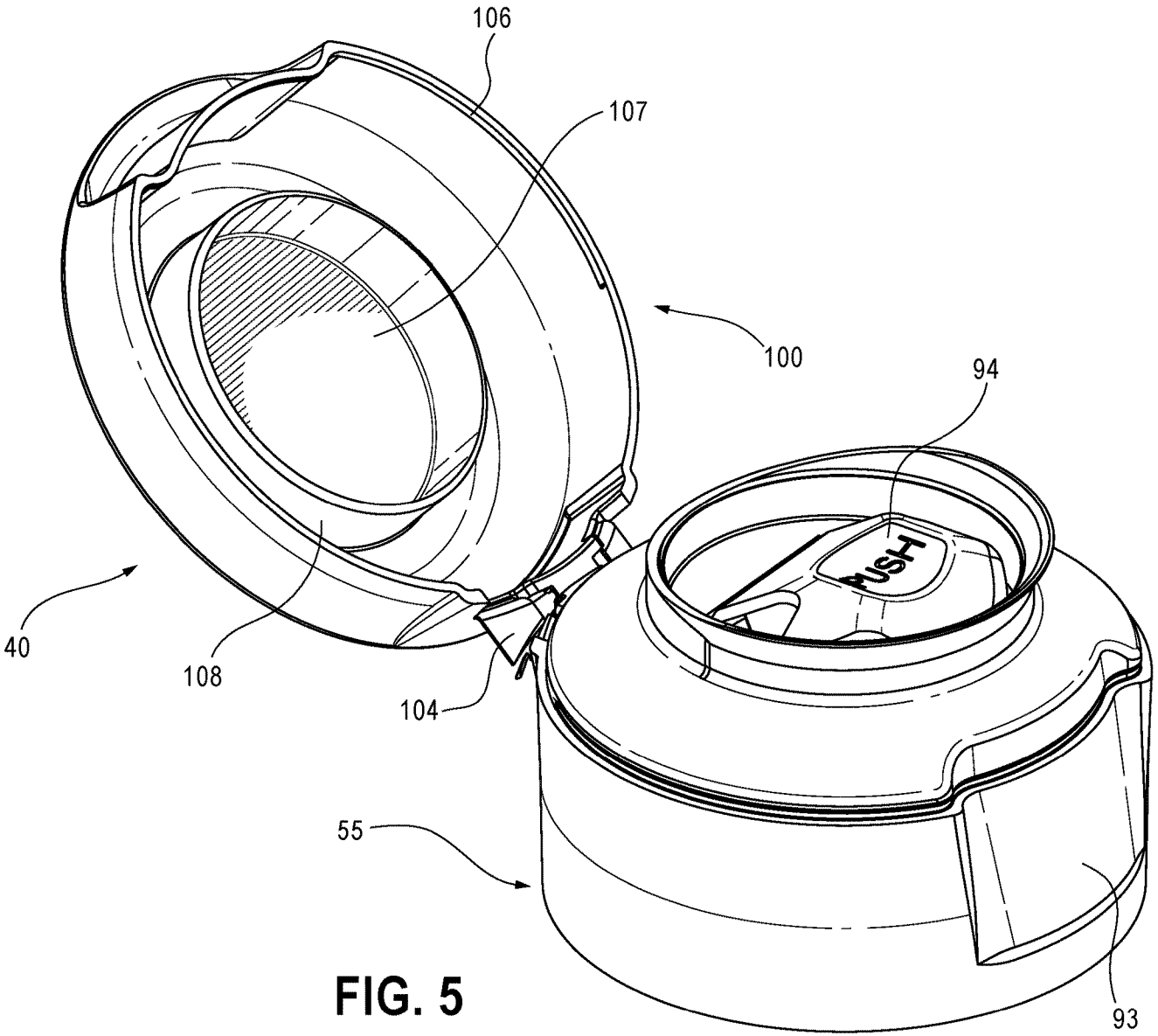
FIG. 5 is an isometric view, taken from the front and above, of the dispensing closure of FIG. 2.

With reference now to FIGS. 5 and 6, the overcap or second body 55 of the closure 40 is generally cylindrical, hollow and surrounds portions of the fitment or first body 54. The second body 55 defines a dispensing orifice 88 (FIG. 6) which is occluded or covered by the membrane 60 of the first body 54 prior to partial breach or rupture of the membrane 60 from the first peripheral wall 56. A pour lip 89 (FIG. 6) extends axially and laterally outwardly from a top deck 92 (FIG. 6) around the perimeter of the dispensing orifice 88 and defines a pour path for directing flow of a fluent substance through the second body 55 upon breach of the membrane 60.

Figure 10:
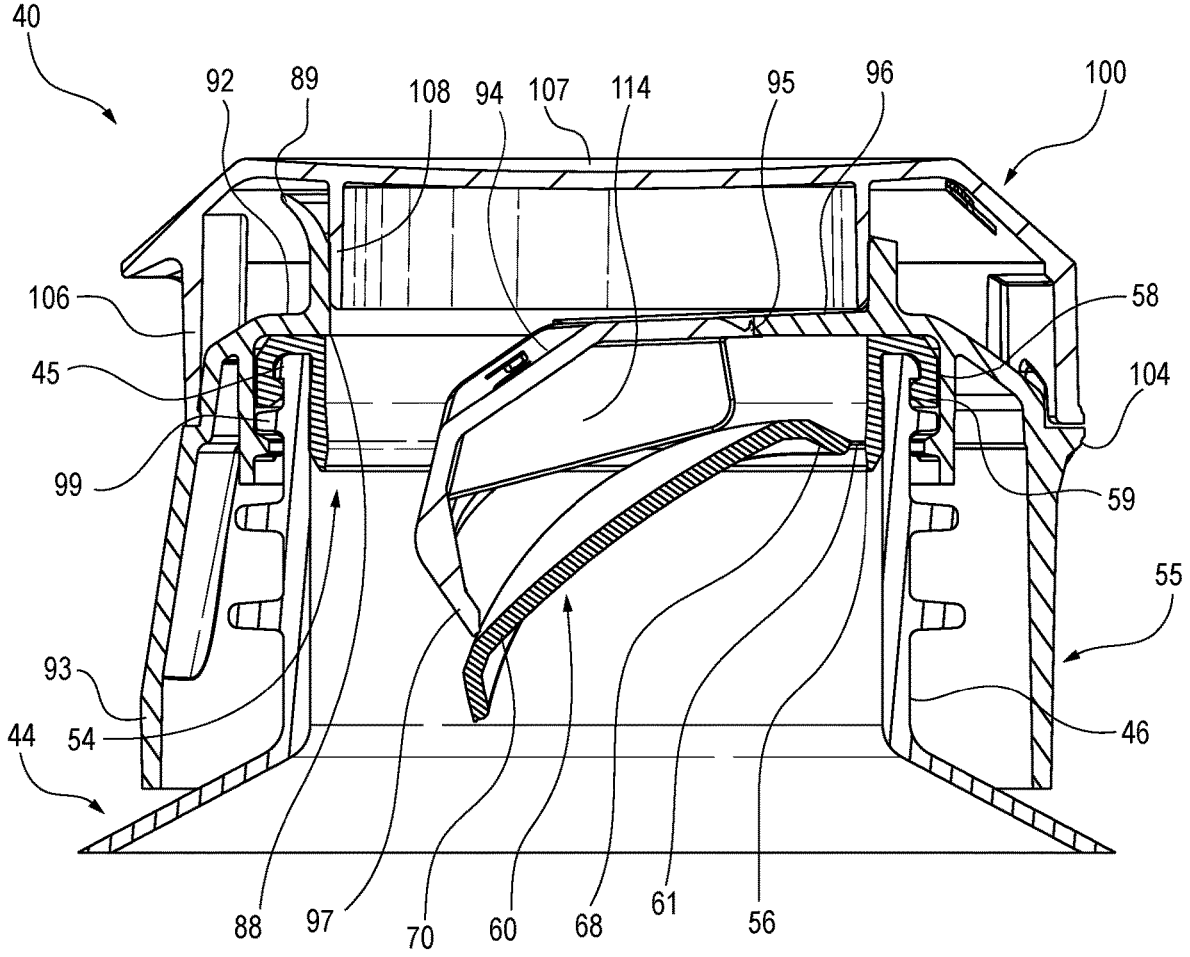
FIG. 10 is a cross-sectional view of the dispensing closure and fragmentary portion of the container of FIG. 1.

The top deck 92 of the second body 55 connects to an outer wall or skirt 93 which surrounds the top end 46 of the container 44 and the first body 54 when the assembled closure 40 is installed at the opening of the container 44 (as illustrated in FIGS. 10 and 11). The second body 55 further includes a means for accommodating engagement by a user to breach only a portion of the membrane 60 in a direction axially inwardly toward the interior of the container 44. The preferred means in the first illustrated embodiment of the closure 40 is a push portion 94 that is rotatably connected to the remainder of the second body 55 by a film or living hinge 95 connected to a transverse wall 96 extending across a portion of the orifice 88. The push portion 94 defines a spade or cantilevered end 97 that, in an unactuated, as-molded configuration (FIG. 6), is located axially above the membrane 60 proximate to the connection 61 with the first peripheral wall 56 of the first body 54. As will be discussed in greater detail hereinafter, the arrangement of the push portion 94 functions to permit a user of the closure 40 to easily separate or breach only a portion of the membrane 60 without requiring the full separation and removal of the membrane 60 from the closure 40, and avoids the difficulties presented by foil liners in current recycling streams. The end 97 is shaped to guide the breached membrane 60 to tear in a predetermined region proximate to the thinned connection 61. The push portion 94 may include indicia to indicate to user the mechanical input required to actuate the push portion 94 to breach the membrane 60.

Referring now to FIGS. 10 and 11, the second body 55 further includes an attachment means in the form of a bead or projection 98 for mating with a corresponding annular flange or shoulder 99 extending laterally outwardly from the neck 46 of the container 44. It will be understood that the second body 55 may have other removable or non-removable attachment means or features for securing the body 55 with the container 44 and/or the first body 54, such as mating threads, deformable and non-removable bands or flanges, toggle clamps, friction fittings, locks, adhesives, welding, etc.

Figure 7:
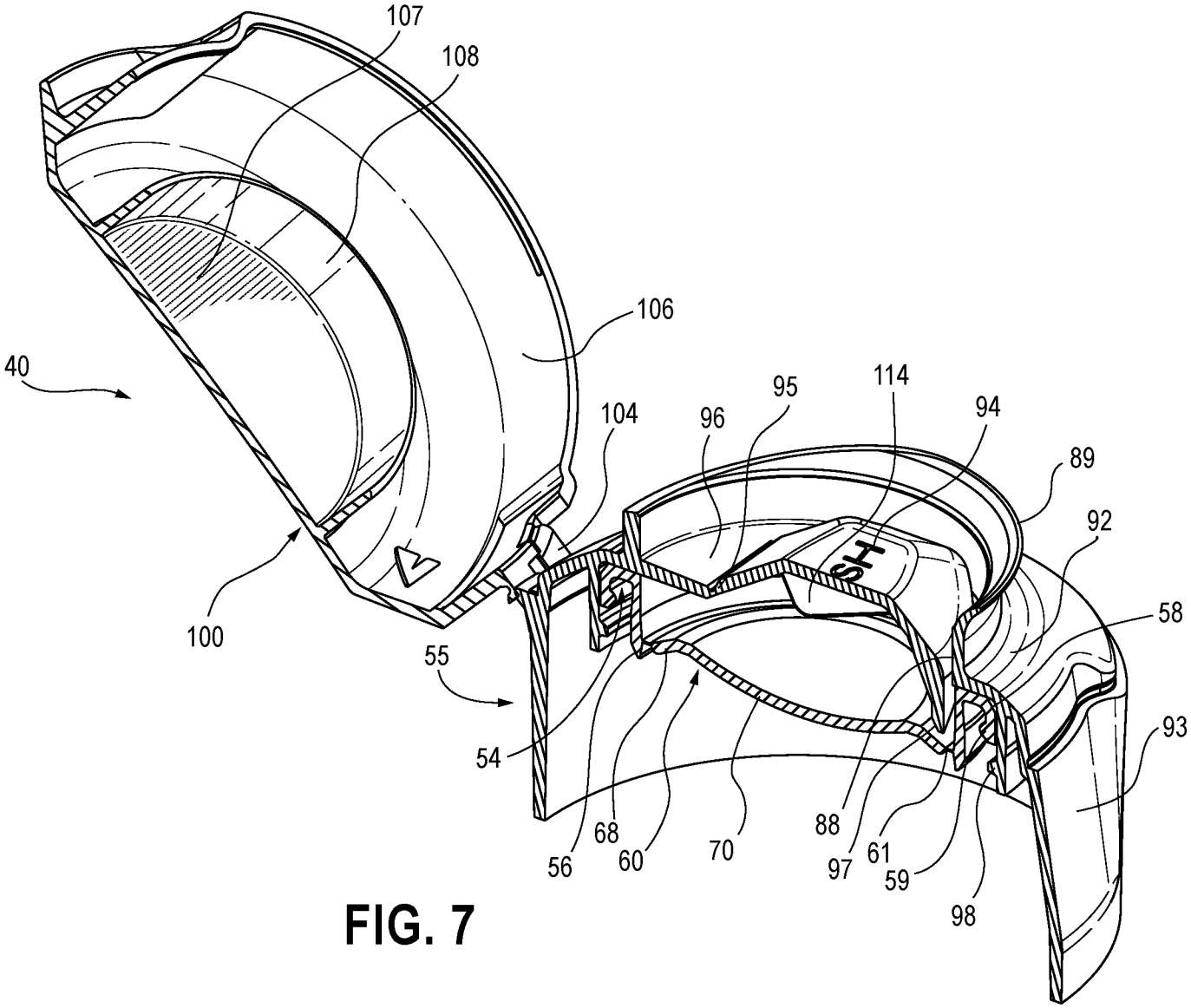
FIG. 7 is an isometric cross-sectional view of the dispensing closure, taken along view plane 7-7 in FIG. 4.
Figure 8:
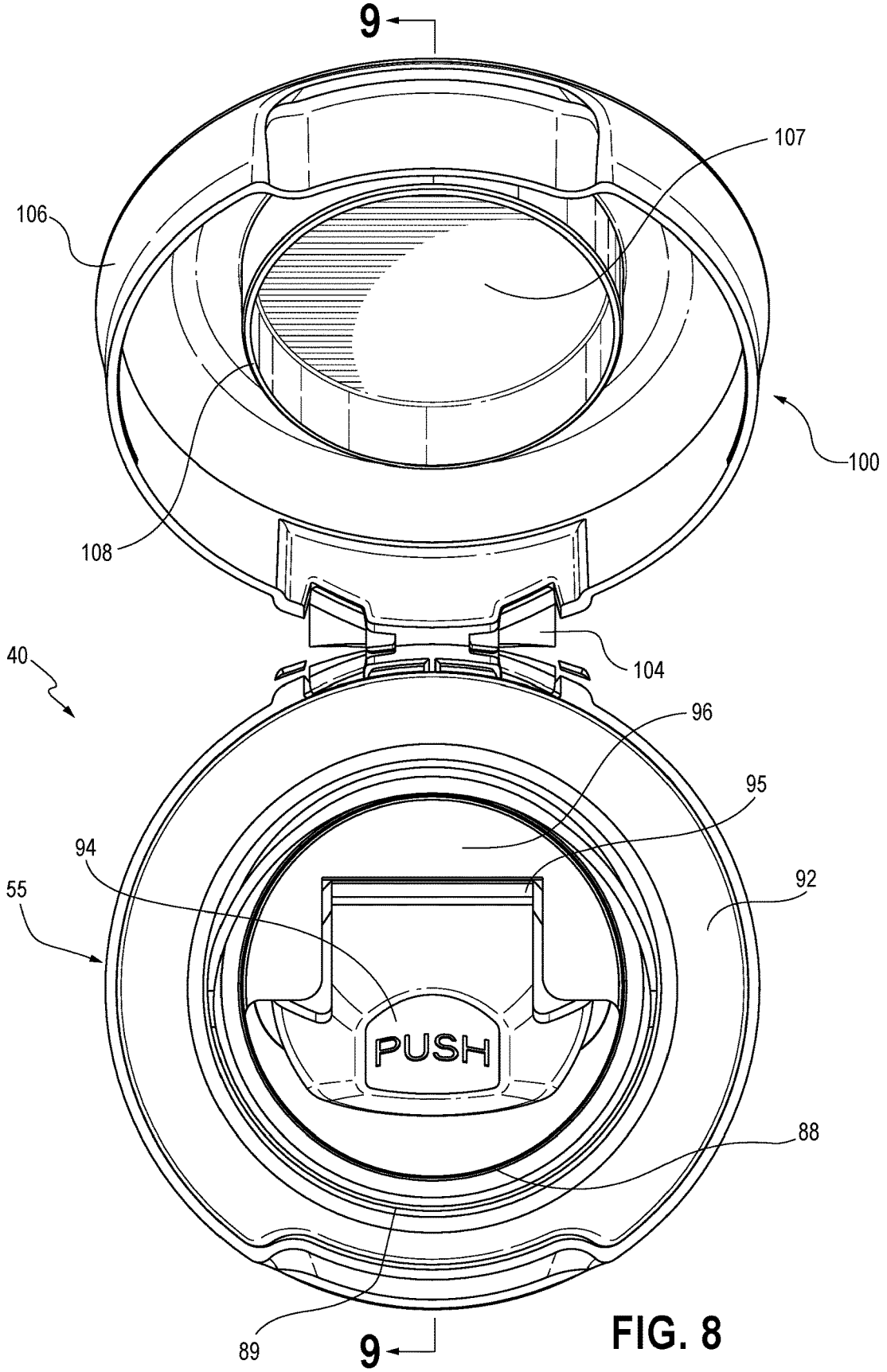
FIG. 8 is a top plan view of the dispensing closure of FIG. 2.

With reference now to FIG. 7, the second body 55 includes a lid 100 that is connected to the top deck 92 by a hinge 104. The hinge 104 is molded unitarily with the lid 100 and the second body 55 at the top deck 92 so as to accommodate movement of the lid 100 between an open position (e.g., FIG. 7) exposing the dispensing orifice 88, and a closed position (e.g., FIG. 1) occluding or covering the dispensing orifice 88 of the second body 55. The hinge 104 may be of any suitable conventional or special design. For example, the hinge 104 illustrated in the Figures may be of a conventional snap-action type such as described in the U.S. Pat. No. 5,356,017 or U.S. Pat. No. 5,642,824, the details of which form no part of the present invention. The hinge 104 could also be a non-snap-action type, such as a strap or tether. The lid 100 includes an annular wall 106 terminating at a top end 107. The top end 107 includes a hollow plug seal 108 that extends axially inwardly therefrom to seal the dispensing orifice 88 when the lid 100 is in its closed position. The second body 55 in the region surrounding the dispensing orifice 88 and/or the lid plug seal 108 are sufficiently flexible to accommodate elastic deformation to establish a leak-tight seal therebetween. The lid 100 may have other latching means such as snap fit beads, locks, tabs, etc. The lid 100 may mated with the second body 55 in a wholly removable manner, such as mating screw threads, friction, or snap fit beads, etc. The lid 100 may be omitted altogether in some non-preferred applications.

Figure 9:
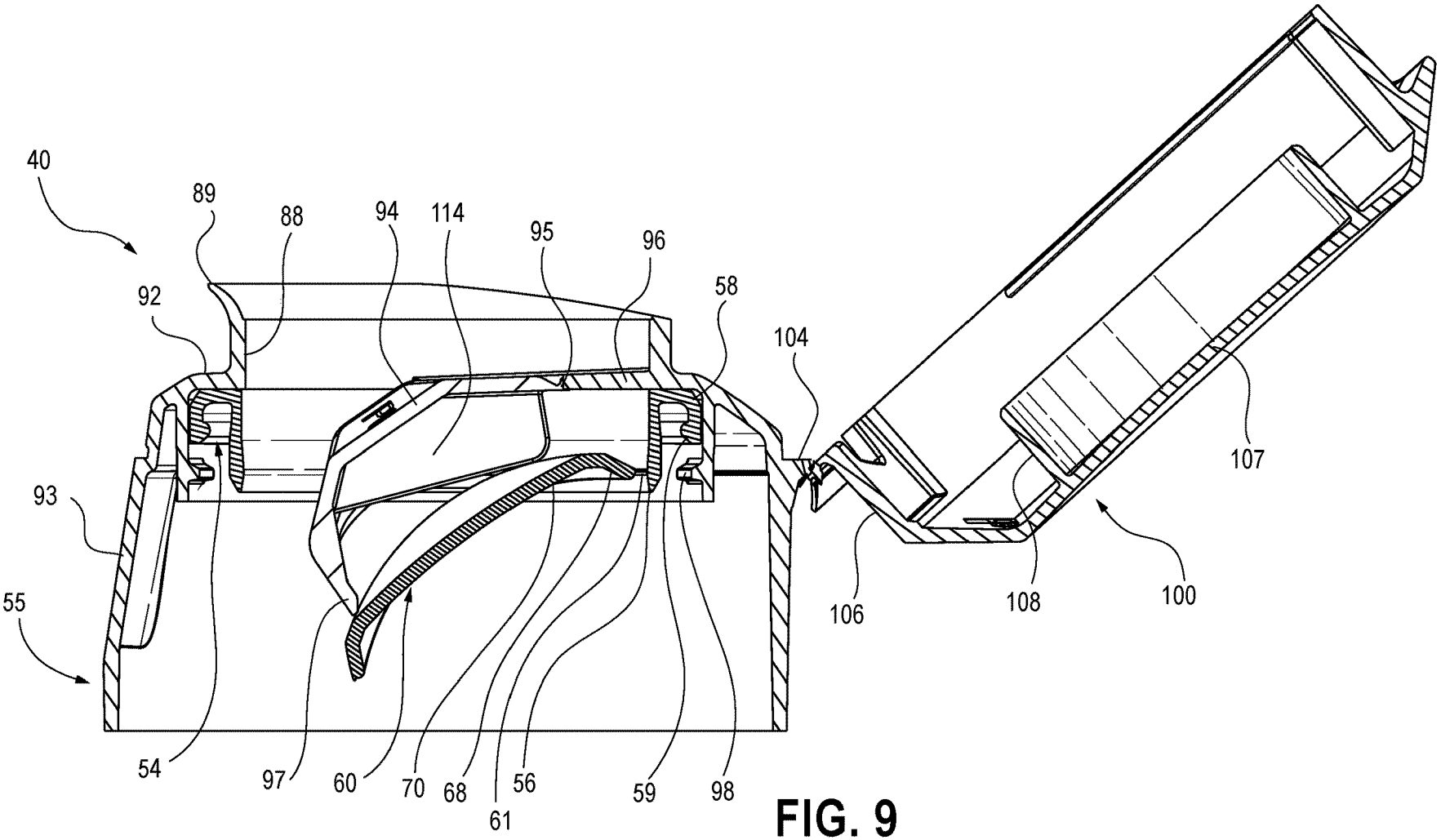
FIG. 9 is a cross-sectional view of the dispensing closure, taken along view plane 9-9 in FIG. 8.

The second body 55 may optionally include one or more projections (not illustrated) that may increase the force required to move the push portion 94 from its unactuated position above the membrane 60 (as illustrated in FIG. 6) to its actuated position having breached the membrane 60 inwardly to expose the dispensing orifice 88 (as illustrated in FIG. 9), and further maintain the push portion 94 in the deflected position to maintain an opened flow path through the closure 40. The projections preferably generate an audible and/or tactile sensation to the user of the closure 40 upon actuation of the push portion 94. It will be understood that the projections may be non-frangible abutments that extend from the transverse wall 93 and/or the push portion 94, and which resist movement of the push portion 94 relative to the transverse wall 93.

With reference now to FIGS. 6 and 7, the push portion 94 is provided with a rib 114 for limiting inward travel of the push portion 94 and membrane 60 during operation and for imparting sufficient stiffness to transmit force of a user's finger through the push portion 94 to the cantilevered end 97 and the membrane 60. It can further be seen that the push portion 94 has an advantageously low profile or axial height (outwardly along central axis "A"), and is located axially below the pour lip 89, which decreases the need for a relatively tall lid 100.

The first body 54 and second body 55 of the closure 40 are preferably formed or molded from a suitable thermoplastic material such as polypropylene or polyethylene. Preferably, the first body 54 and the second body 55 are molded from the same polymer for improved recycling of the closure 40. Other materials may be employed instead. It will be understood that in alternative designs (not illustrated), one or more of the basic components or sub-components may be separately or sequentially formed or molded (such as through bi-injection molding). Alternatively, in a non-preferred embodiment, the basic components may be molded initially as one connected, unitary structure, and then broken apart, and then re-assembled into an operative combination or assembly.

One method of assembling the closure 40 with a container 44 of a fluent substance to form a package that would be encountered by a customer or user is next discussed. It will be understood that the method of assembly described herein is illustrative only, and there may be other methods of assembling the package. The closure 40, including the first body 54 and the second body 55, are preferably molded as separate articles of manufacture and may be shipped separately or as a sub-assembly (i.e., with the first body 54 loosely retained within the bottom of the second body 55) to a filler facility. The plug seal 108 of the lid 100 may be placed into a sealing, frictional engagement with the dispensing orifice 88 of the second body 55 prior to shipping. The filler facility then fills the interior of the container 44 with a pre-determined amount or dose of a substance to be dispensed (not illustrated). The first and second peripheral walls 56 and 58 of the first body 54 are axially installed around the neck 46 of the container 44 such that the bead 59 of the first body 54 engages and slips beneath the bead 45 of the container 44, and the first peripheral wall 56 seals against the opening of the container 44.

The overclosure or second body 55 is then axially installed around the top end of the container 44 such that the non-removable attachment bead 98 slips beneath and engages the underside of the flange 99 on the neck 46 of the container 44 such that the cantilevered end 97 of the push portion 94 is positioned axially above the sloping peripheral portion 68 of the membrane 60. Advantageously, the present invention design of the closure 40 does not require that the first and second bodies 54 and 55, respectively, be oriented in any specific rotational arrangement, reducing the cost and complexity of assembling the closure 40.

The filled container 44 with the closure 40 installed in the closed position is thus provided to the consumer in the form a completed package.

The detailed operation and function of the closure 40 will next be described. Typically, a user, such as a customer, will encounter the closure 40 installed upon the fluent substance container 44 as a package with the lid 100 in the closed position (e.g., as the lid 100 is shown in FIG. 1). The user would open the lid 100 by rotating it relative to the top deck 92 about the hinge 104 into an open position to disengage the plug seal 108 from the dispensing orifice 88.

With reference to FIGS. 6 and 9, the user would then press downwardly with a finger or thumb against the push portion 94. The downward force acting on the push portion 94 would overcome any resistance of any projections (not illustrated), resulting in a tactile and/or audible indication to the user. Further contact with the push portion 94 drives the cantilevered free end 97 against the sloping peripheral portion 68 of the membrane to initiate a tear or break of the connection 61 between the membrane 60 and the remainder of the first body 54. As the user continues to press inwardly on the push portion 94, the membrane 60 folds or deflects inwardly toward the interior of the container 44 while remaining attached to the first body 54 at a location opposite the pour lip 89. The arrangement of the first body 54 and the second body 55 advantageously provides a clear tamper evidence indication to a user of the closure 40.

The user may grasp and tilt the container 44, and pour an amount of fluent substance from the interior of the container 44 through the exposed orifice 88 along the pour path defined by the pour lip 89.

After dispensing the fluent substance through the closure 40, the user may then return the lid 100 to its closed position by rotating the lid 100 about the hinge 104 relative to the top deck 92 such that the lid plug seal 108 re-seals around in the orifice 88.

A second embodiment of a closure 40A according to the present invention is illustrated in FIGS. 12-21, which has an actuation configuration for permitting dispensing through the closure 40A. The sealing arrangement between the first body 54A and the second body 55A is otherwise the same as the previously discussed first embodiment of the closure 40. Like elements between the first illustrated embodiment of the closure 40 and the second illustrated embodiment of the closure 40A are designated with the same numeral (the first embodiment numbered features having no suffix and the second embodiment having numbered features with an "A" suffix). The second illustrated embodiment of the closure 40A has the same basic elements as the first illustrated embodiment of the closure 40, namely a first body 54A installed within the opening of the container 44A and a second body 55A covering the first body 54A.

Figure 17:
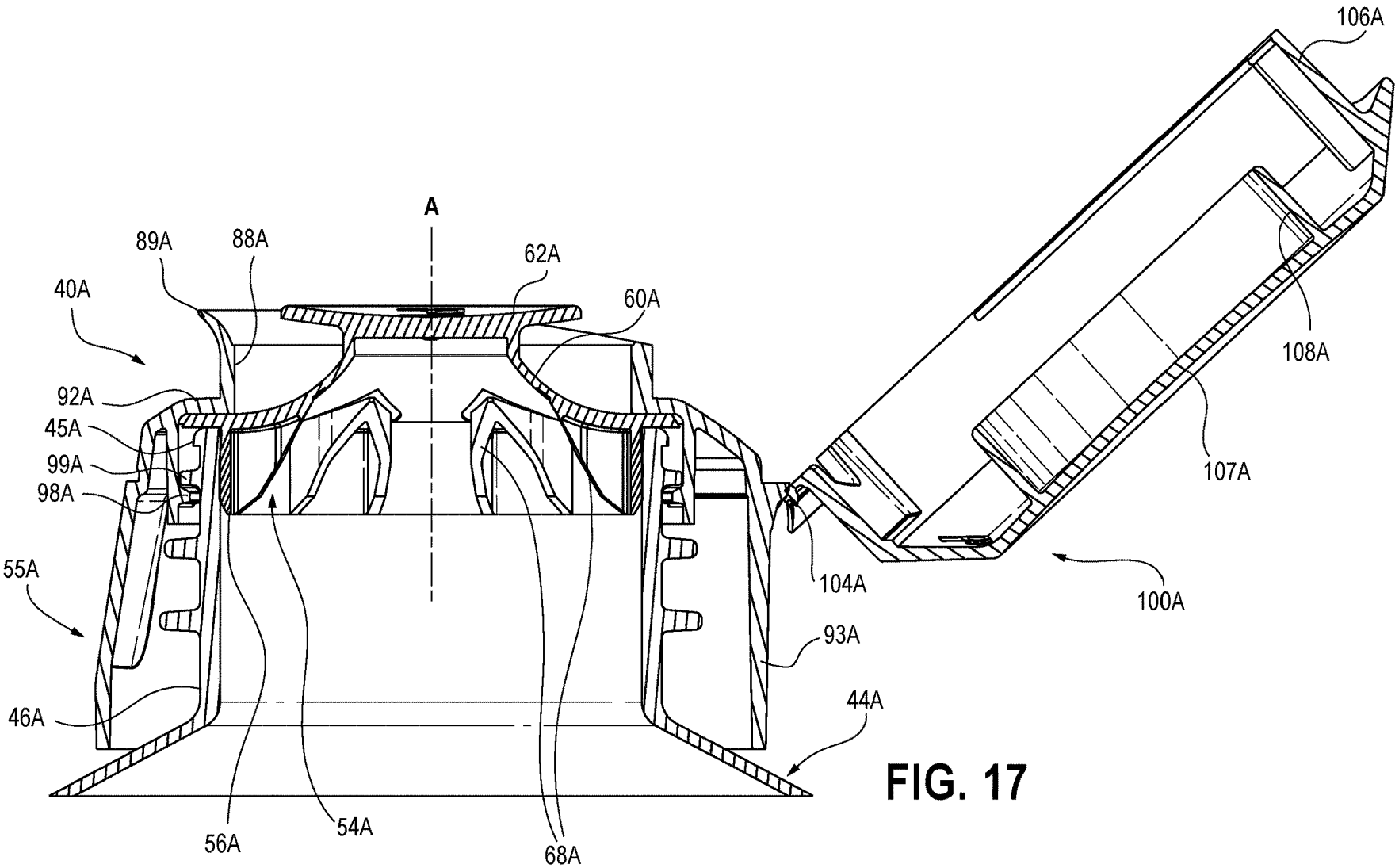
FIG. 17 is a cross-sectional view of the dispensing closure and the container, taken along view plane 17-17 in FIG. 16.
Figure 18:
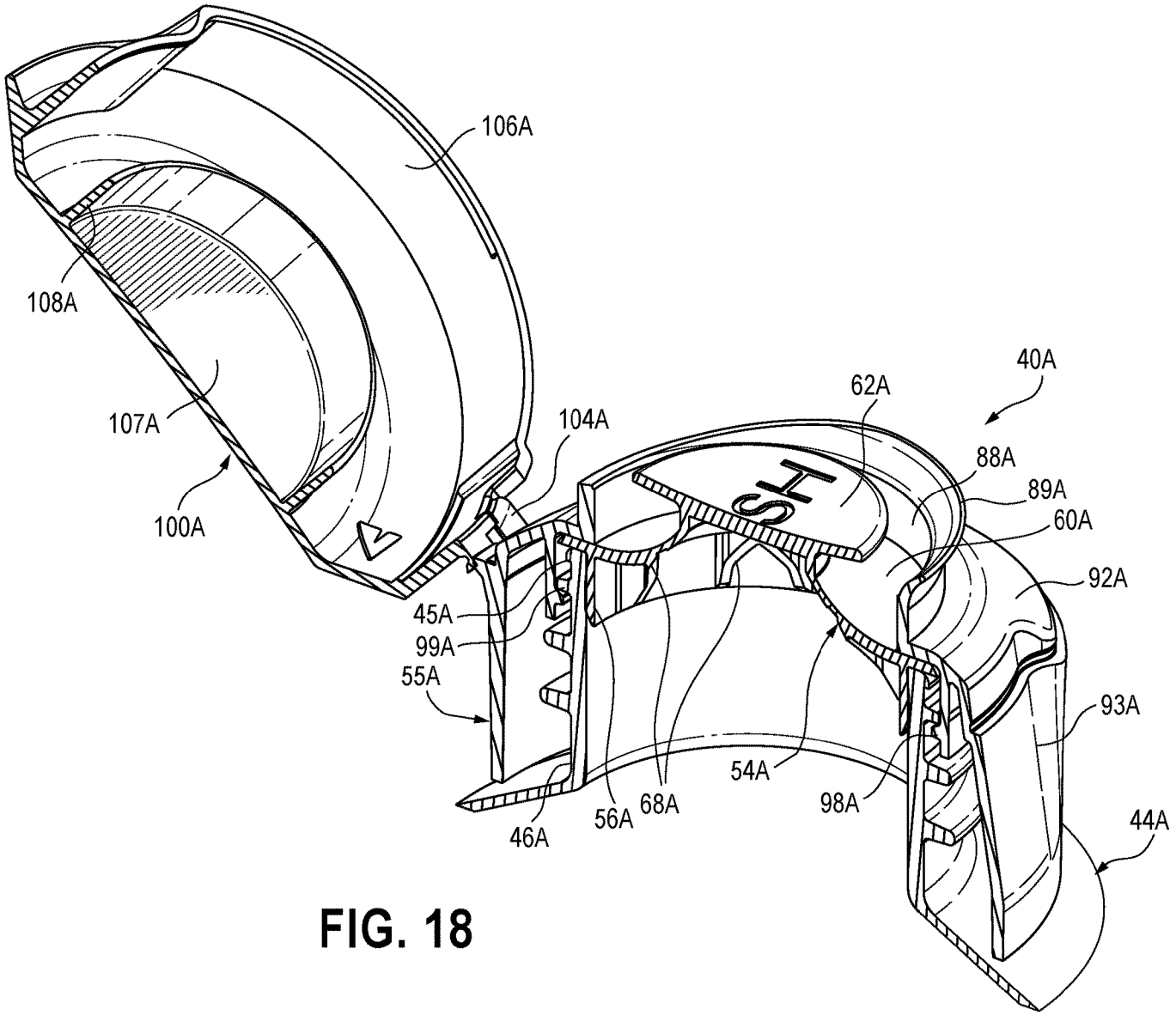
FIG. 18 is an isometric cross-sectional view of the dispensing closure and the container, taken along view plane 18-18 in FIG. 16.
Figure 19:
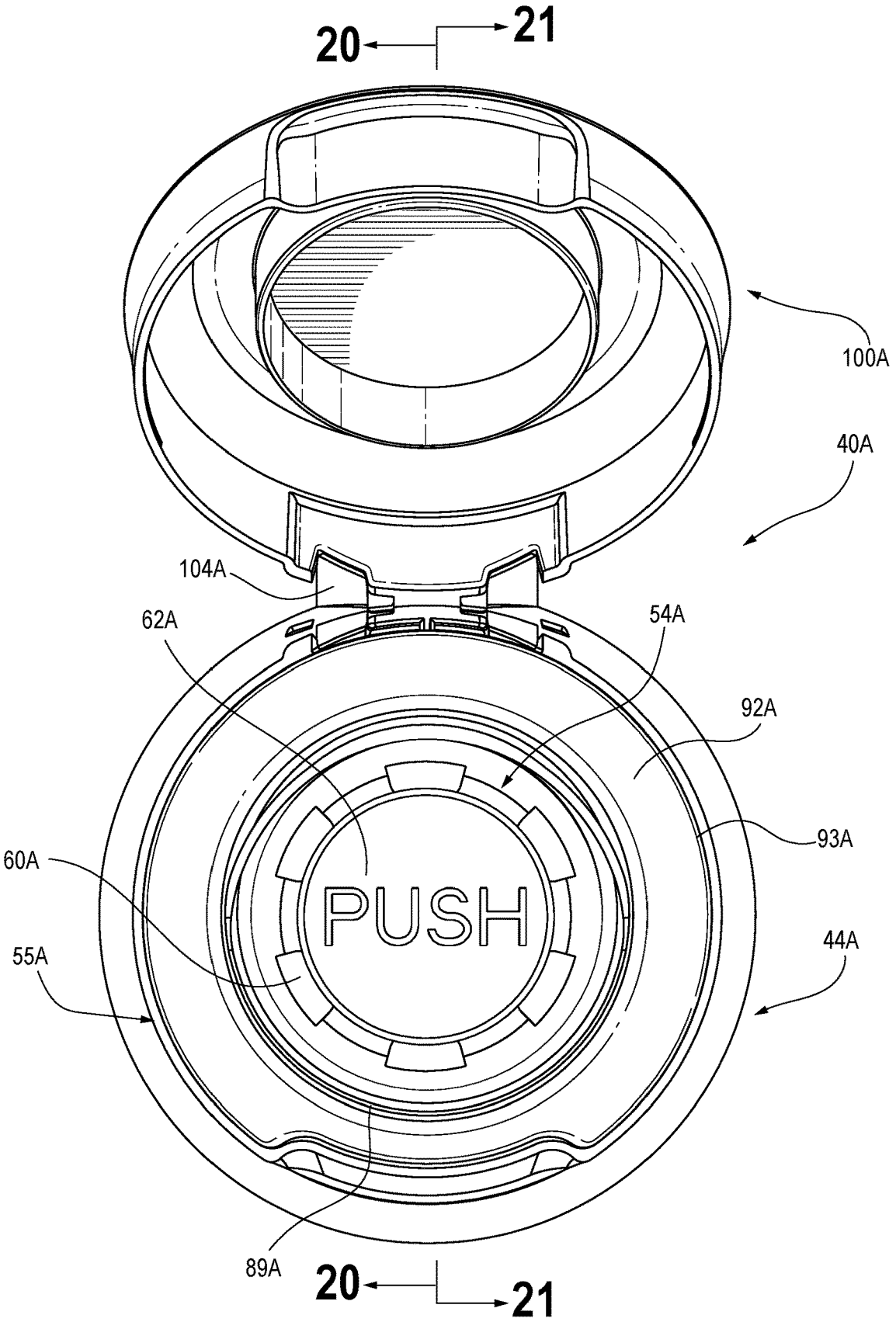
FIG. 19 is a top plan view of the dispensing closure and container of FIG. 13.

Referring to FIGS. 17 and 18, the second illustrated embodiment of the closure 40A differs from the first illustrated embodiment of the closure 40 in that the first body 54A includes a modified structure including a disc-like push portion 62A connected to, and extending axially outwardly above, the membrane 60A. The first body 54A further includes a plurality of wedge-shaped piercing ribs 68A extending radially inwardly from the first peripheral wall 56A beneath the membrane 60A. Each piercing rib 68 terminates in a pointed end that is located axially outwardly (i.e., above) the first peripheral wall 56A. The push portion 40A is advantageously located laterally adjacent within the dispensing orifice 88A of the second body 55A, providing the closure 40A an advantageous low profile or axial height, which eliminates the need for a relatively tall lid 100A.

Figure 20:
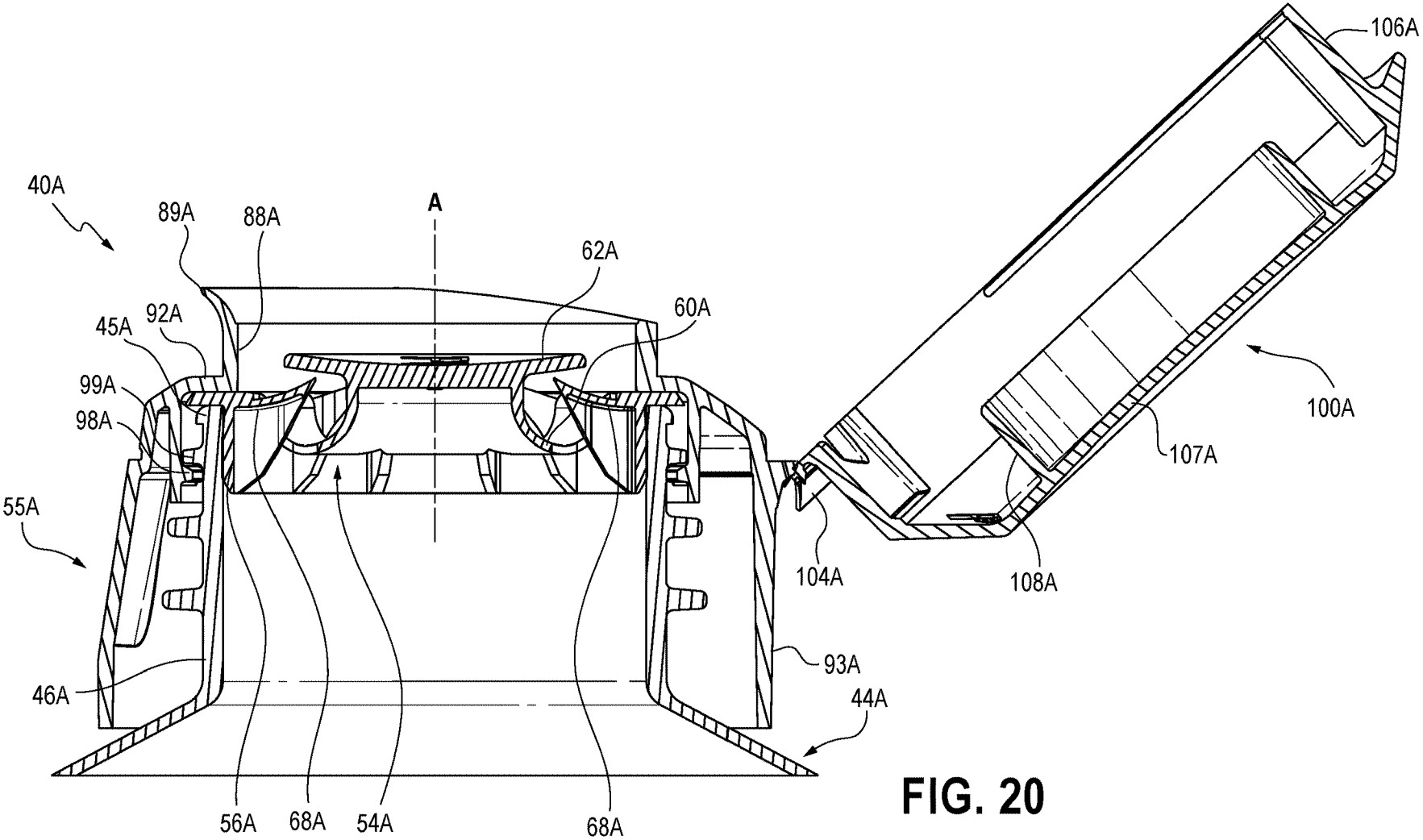
FIG. 20 is a cross-sectional view of the dispensing closure, taken along view plane 20-20 in FIG. 19.
Figure 21:
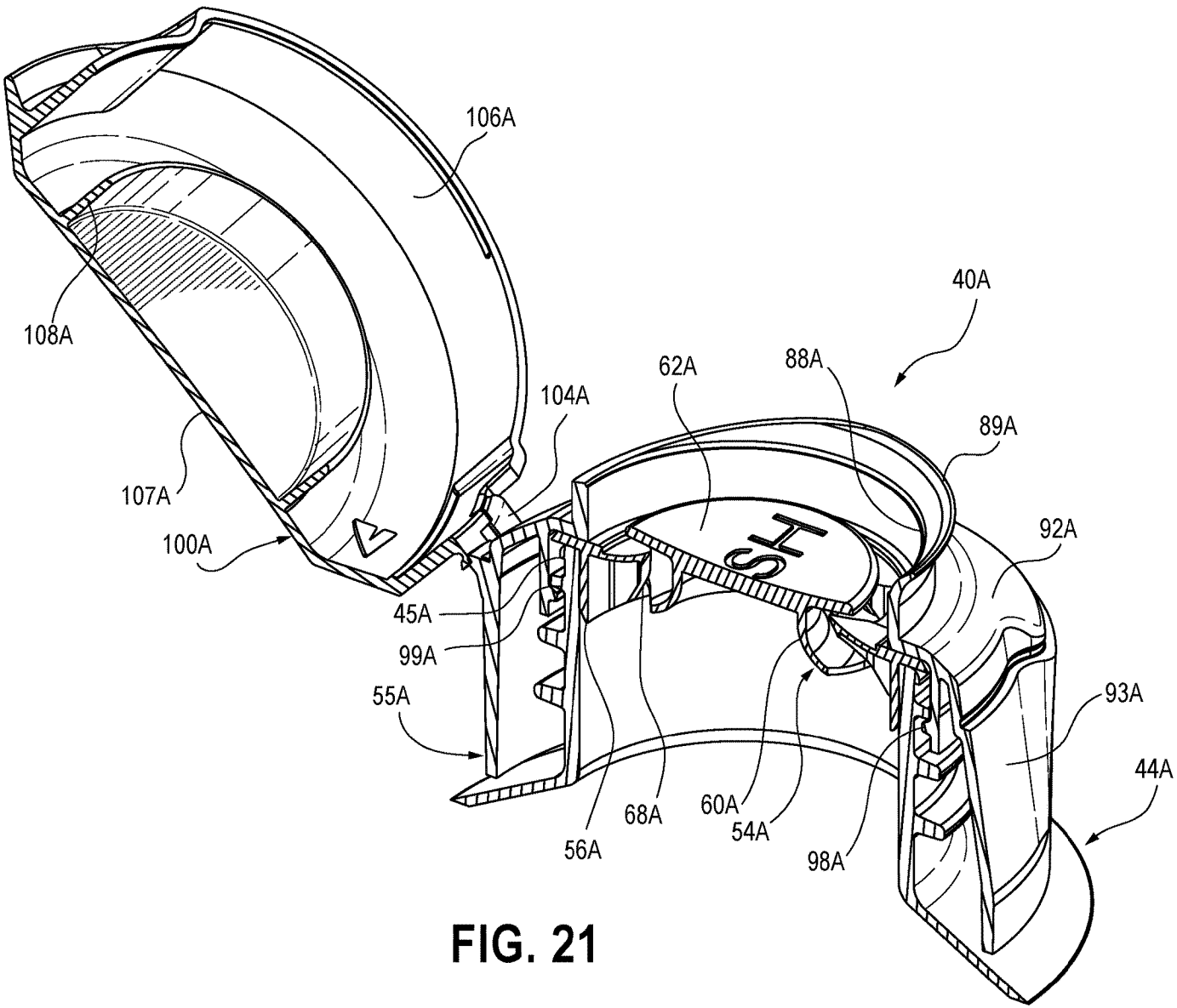
FIG. 21 is an isometric cross-sectional view of the dispensing closure and fragmentary portion of the container, taken along view plane 21-21 in FIG. 19.
Figure 22:
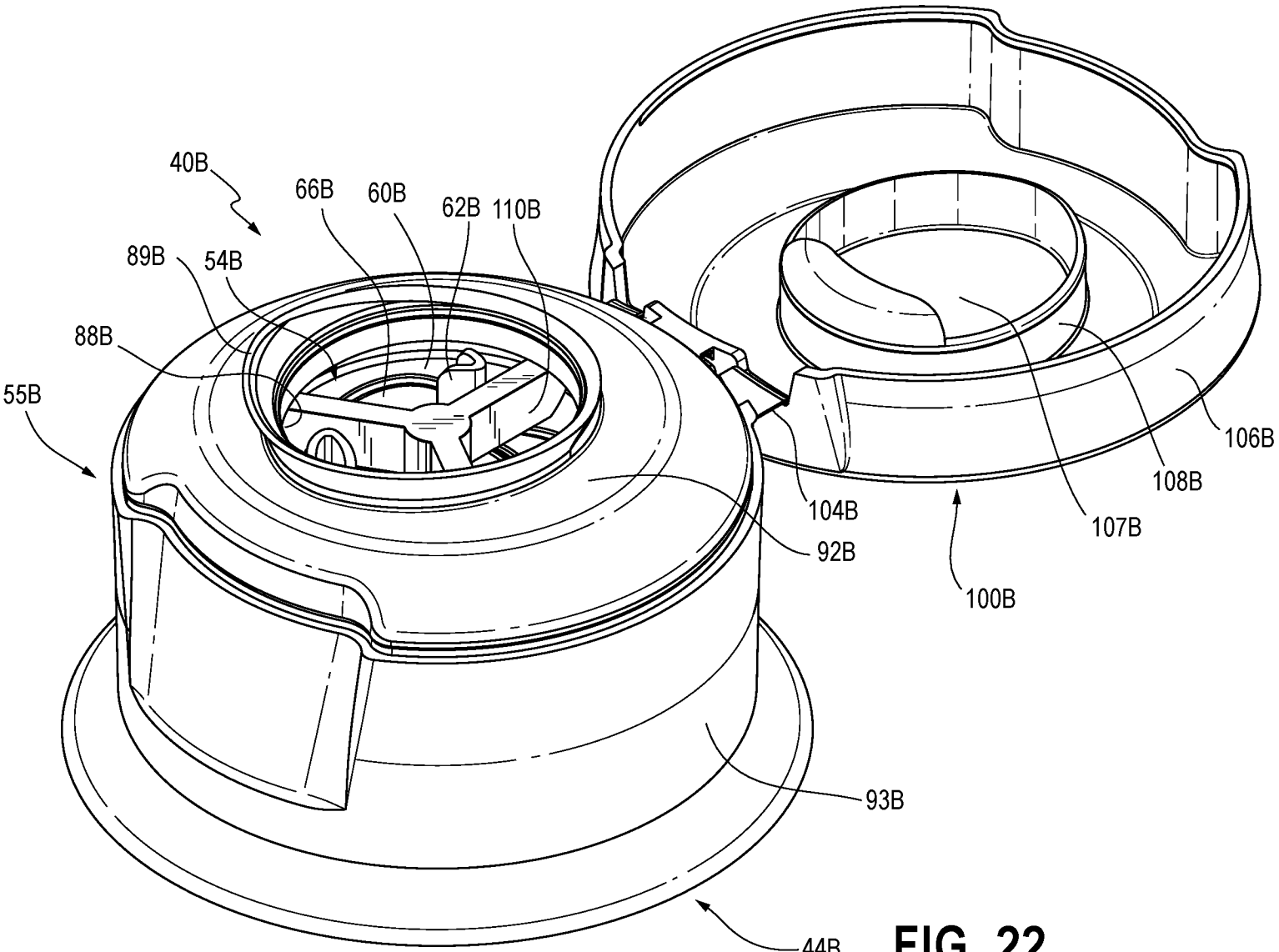
FIG. 22 is an isometric view, taken from the front and above, of a third embodiment of a dispensing closure according to the present invention installed upon a fragmentary upper portion of a container.

With reference to FIG. 20, the membrane 60A is sufficiently flexible such that engagement of a user's finger or thumb against the push portion 62A drives the membrane 60A and push portion 62A axially inwardly to tear or breach portions of the membrane adjacent the piercing ribs 68A. The piercing ribs 68A inherently stop or limit travel of the push portion 62A in the axially inward direction. The fluent substance stored within the container 44A may flow through the torn or breached portions of the membrane 60A between the piercing ribs 68A. The tearing of the membrane 60A advantageously provides a clear tamper evidence indication to a user of the closure 40A. The first body 54A and/or the second body 55A may be provided with a locking mechanism or mating projections to maintain the push portion 62A in its actuated, deflected position to ensure adequate flow through the dispensing orifice 88A.

With reference to FIG. 17, the first body 54A of the closure 40A preferably does not possess any second peripheral wall that is connected to, and surrounds, the first peripheral wall 56A. However, it will be understood that in some applications such a second peripheral wall may be provided which functions just like the wall 58 in the first embodiment of the closure 40.

The first body 54A and second body 55A of the closure 40A are preferably formed or molded from a suitable thermoplastic material such as polypropylene or polyethylene. Other materials may be employed instead. It will be understood that in alternative designs (not illustrated), one or more of the basic components or sub-components may be separately or sequentially formed or molded (such as through bi-injection molding). Alternatively, in a non-preferred embodiment, the basic components may be molded initially as one connected, unitary structure, and then broken apart, and then re-assembled into an operative combination or assembly. Preferably, the first body 54A and the second body 55A are molded from the same polymer for improved recycling.

A third embodiment of a closure 40B according to the present invention is illustrated in FIGS. 22-32, which has a modified configuration of the first body 54B and the second body 55B that may present the user with a different mode of actuating the closure 40B, as compared to the first illustrated embodiment of the closure 40. Like elements between the first illustrated embodiment of the closure 40 and the third illustrated embodiment of the closure 40B are designated with the same numeral (the first embodiment numbered features having no suffix and the third embodiment having numbered features with a "B" suffix). The third illustrated embodiment of the closure 40B has the same basic elements as the first illustrated embodiment of the closure 40, namely a fitment or first body 54B installed within the opening of the container 44B and an overclosure or second body 55B covering the first body 54B.

Figure 23:
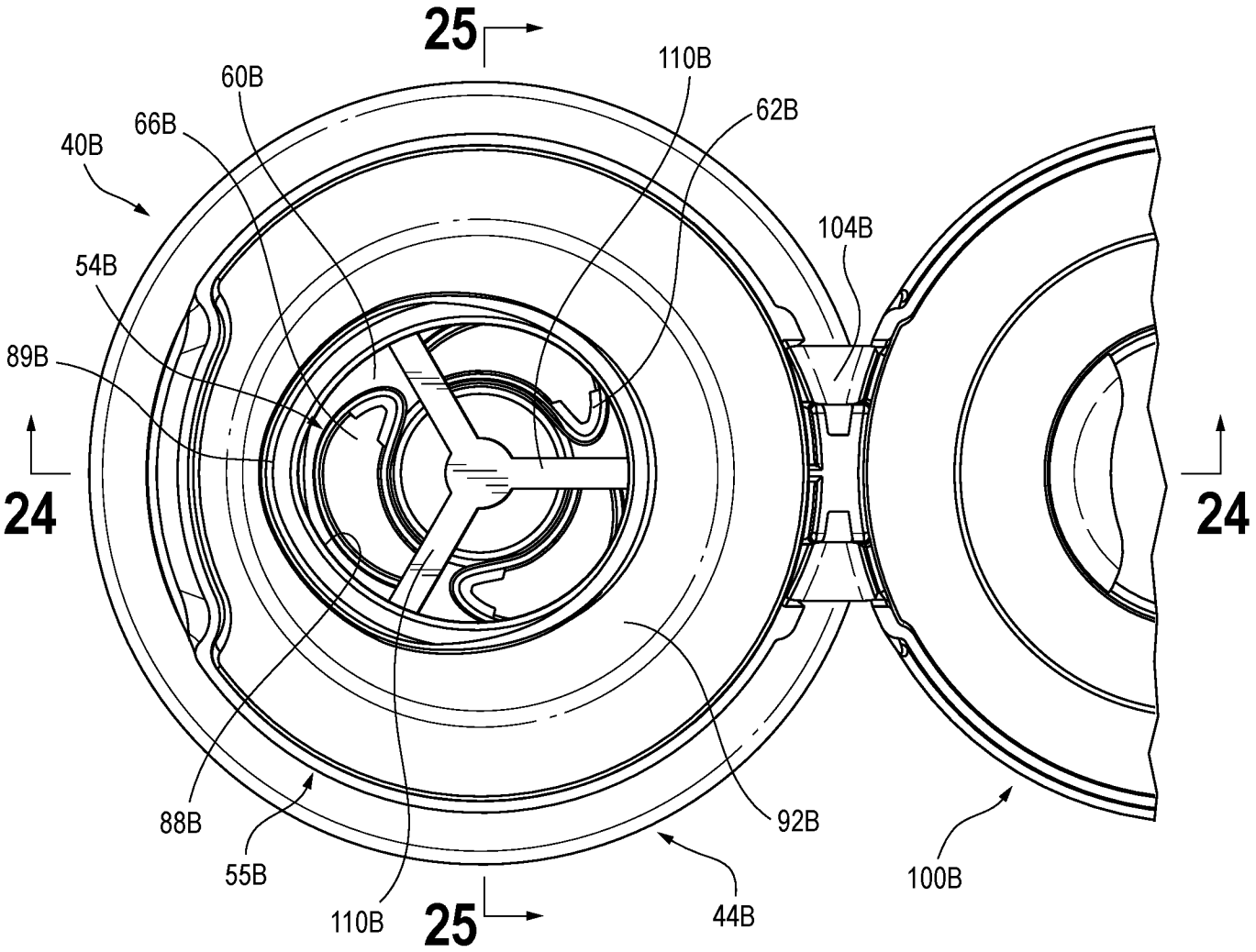
FIG. 23 is a fragmentary, top plan view of the dispensing closure and the container of FIG. 22.
Figure 24:
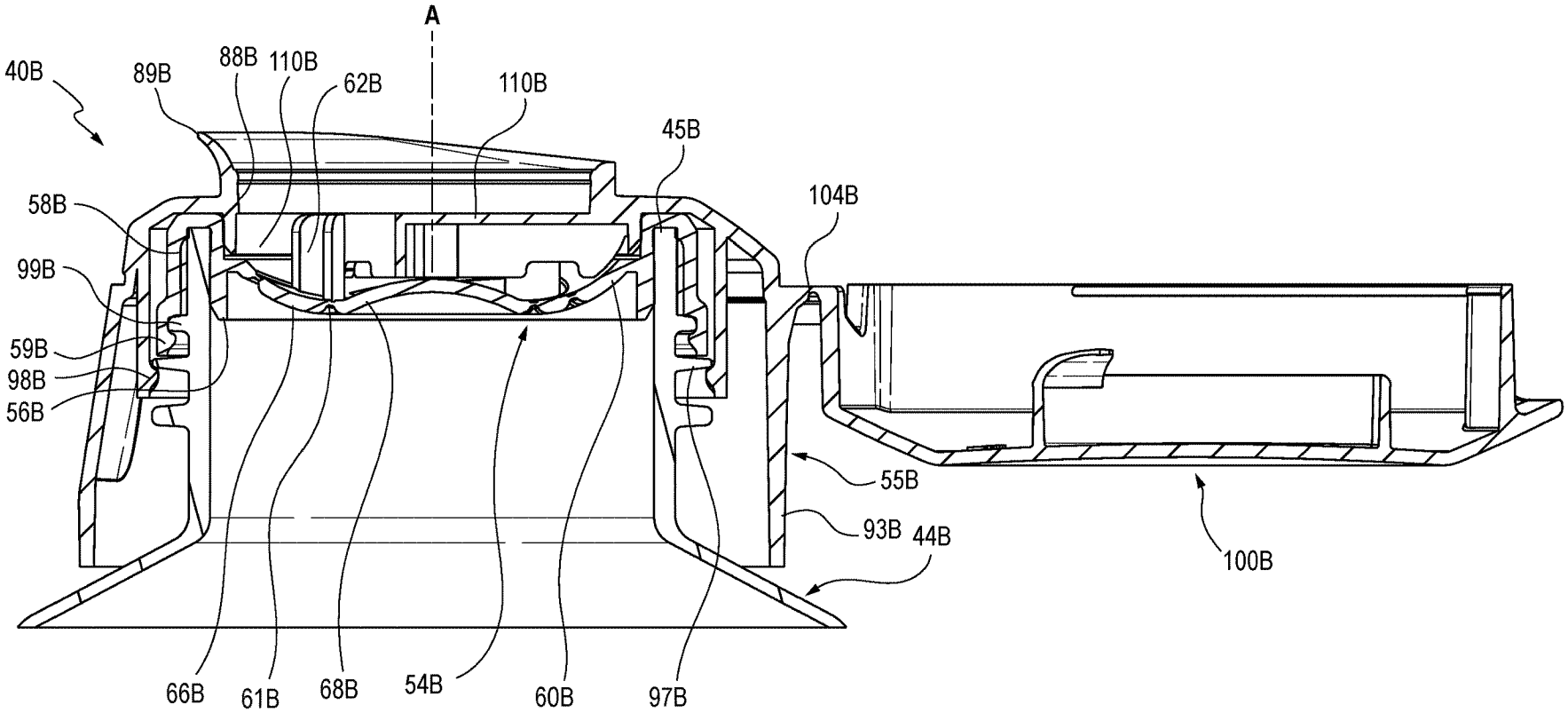
FIG. 24 is a cross-sectional view of the dispensing closure and container, taken along view plane 24-24 in FIG. 23
Figure 25:
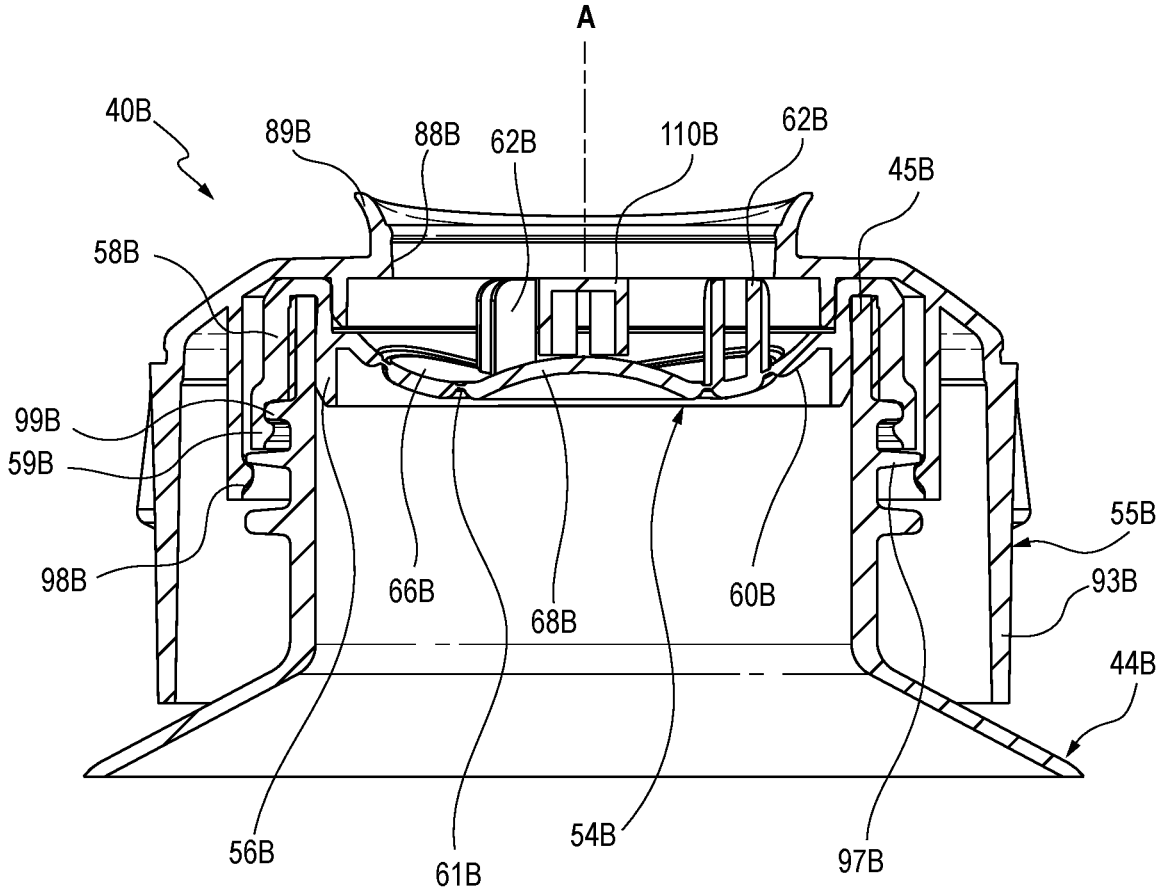
FIG. 25 is a cross-sectional view of the dispensing closure and container, taken along view plane 25-25 in FIG. 23.
Figure 26:
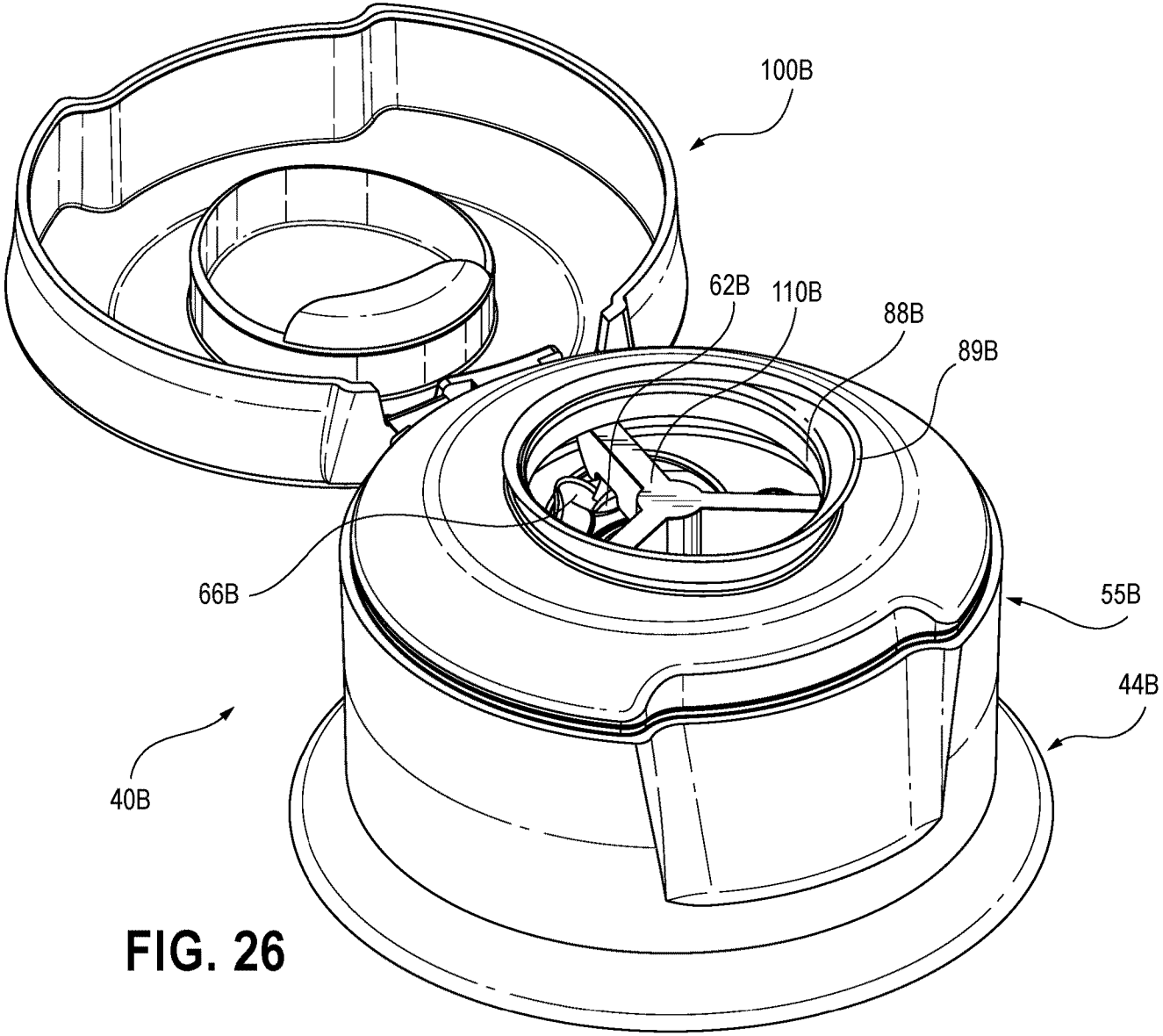
FIG. 26 is an isometric view, from the front and above, of the dispensing closure and container of FIG. 22.
Figure 27:
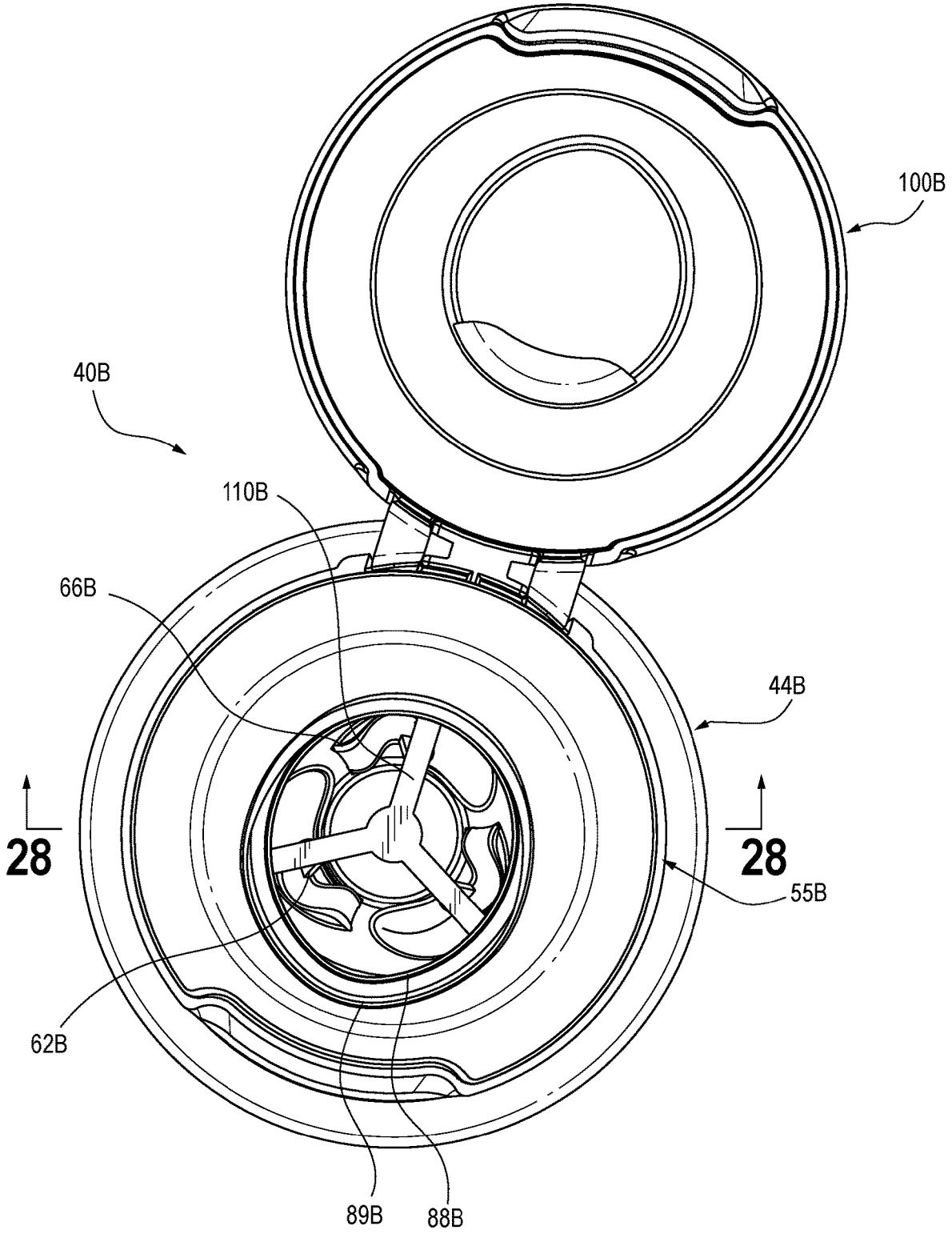
FIG. 27 is a top plan view of the closure and container of FIG. 26.

Referring now to FIGS. 23 and 27, the third illustrated embodiment of the closure 40B differs from the first illustrated embodiment of the closure 40 in that the closure 40B is initially actuated (such that the membrane 60B is breached) by rotation of the second body 55B relative to the first body 54B. The snap-fit connection means between the first body 54B and the container 44B does permit relative rotation, while the snap-fit connection means between the second body 55B and the first body 54B allows for axial rotation of the second body 55B relative to the first body 54B.

As can be seen in FIGS. 23 and 27, the user's relative rotation of the first body 54B and the second body 55B, has the effect of driving one of several spokes or abutments 110B of the second body 55B against a respective one of several projecting posts 62B that project axially outwardly from the membrane 60B. The posts 62B have a V-shaped cross-sectional configuration (in a plane normal to the central axis "A", as viewed in FIGS. 23).

Figure 29:
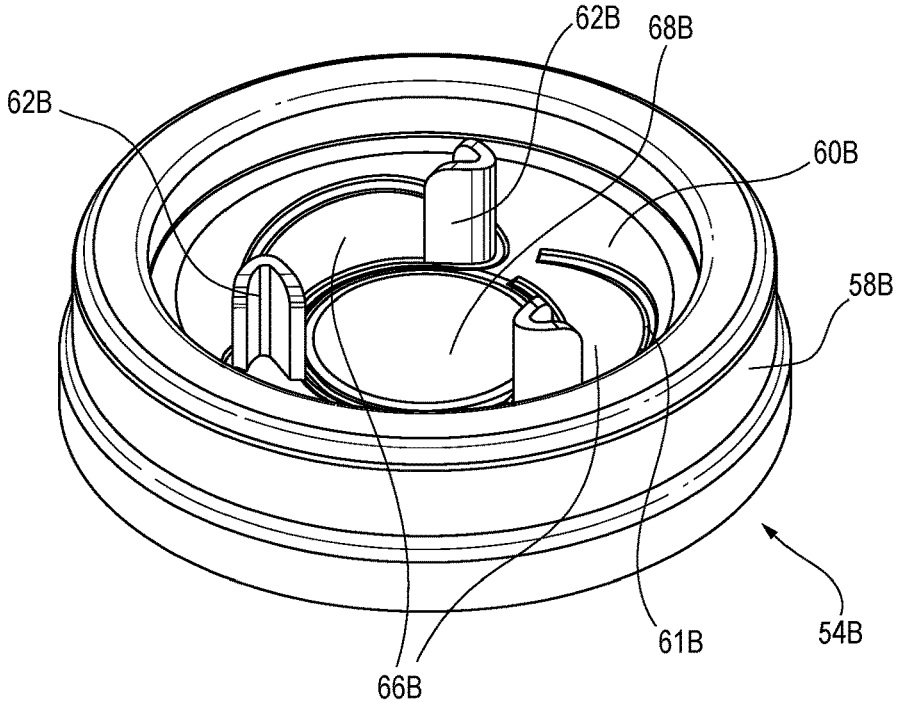
FIG. 29 is an isometric view, taken from above, of only the first body or fitment of the closure of FIG. 22 showing the intact membrane.
Figure 30:
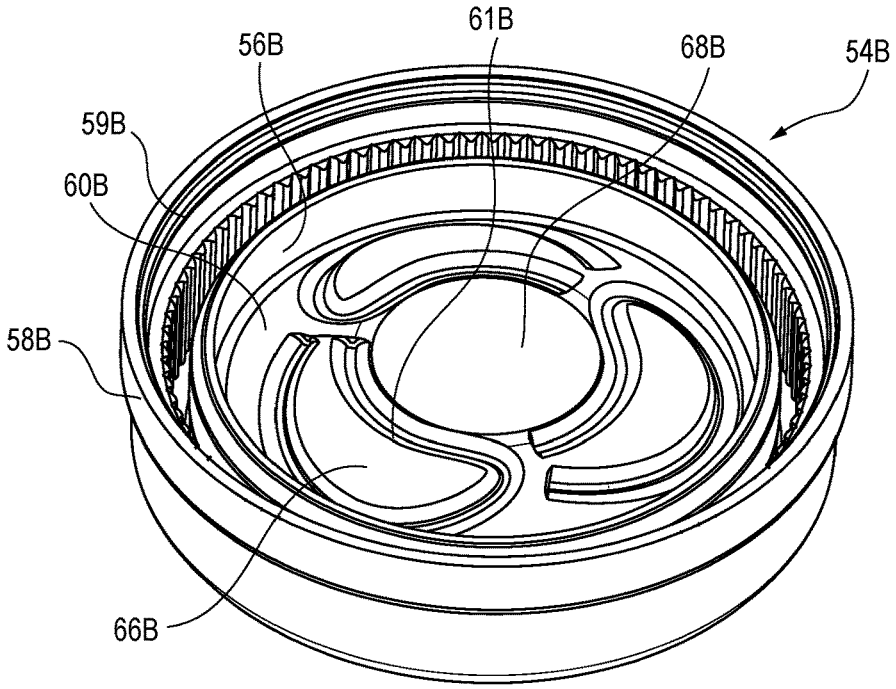
FIG. 30 is an isometric view, taken from below, of the first body of the closure of FIG. 29 showing the intact membrane.

With reference to FIGS. 23 and 29, it can be seen that each one of the posts 62B connects to one arcuate or kidney-shaped frangible section 66B that is separated from the rest of the membrane 60B by a frangible connection or tear path 61B.

Figure 28:
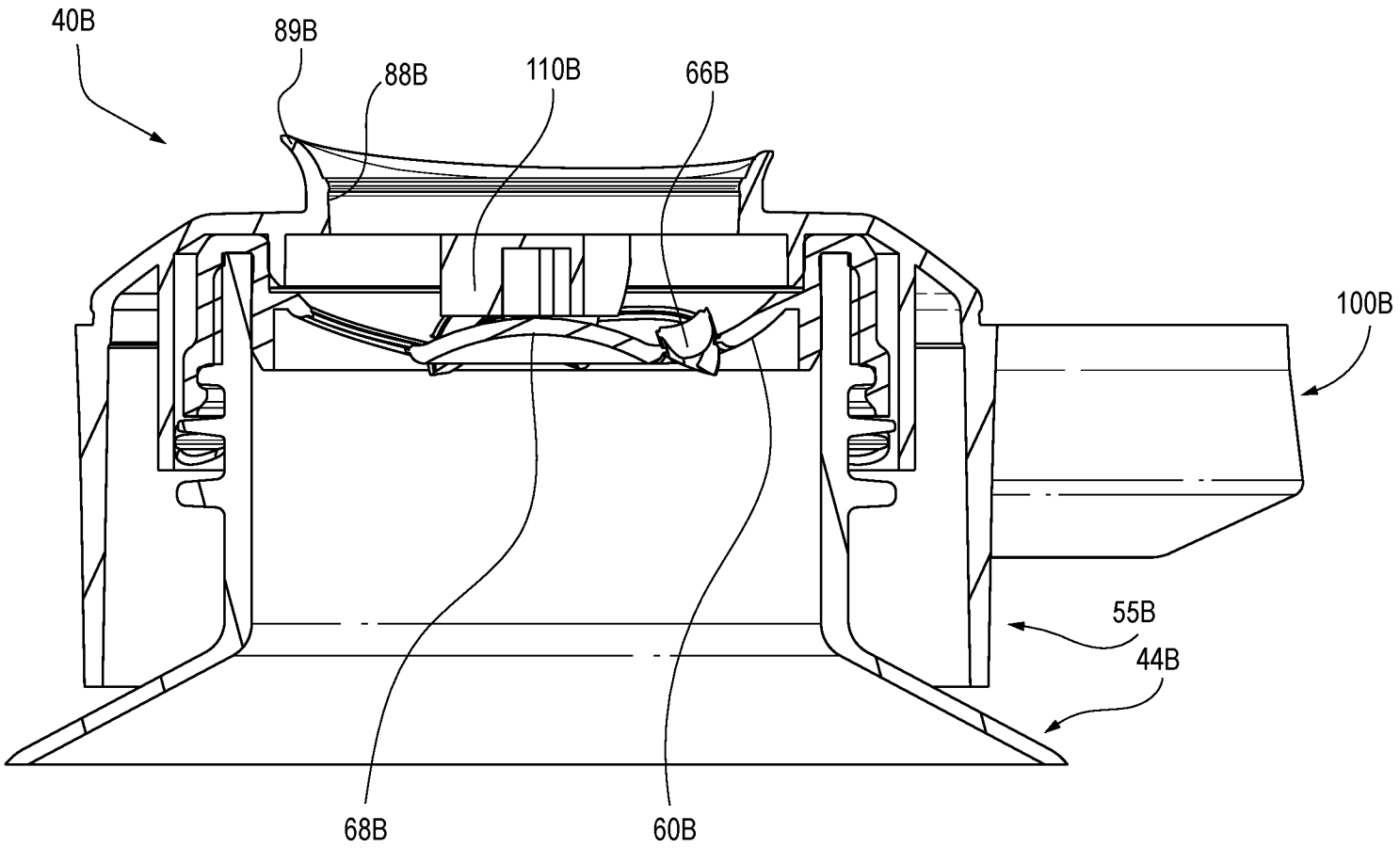
FIG. 28 is a cross-sectional view of the dispensing closure and container, taken along view plane 28-28 in FIG. 27.
Figure 31:
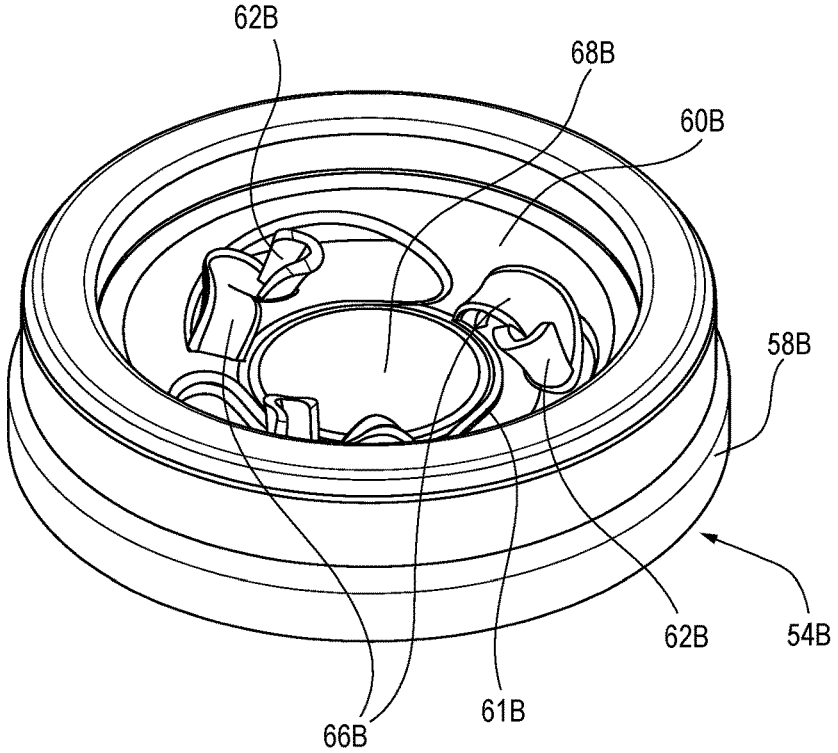
FIG. 31 is an isometric view, taken from above, of only the first body or fitment of the closure of FIG. 22 showing the breached membrane.
Figure 32:
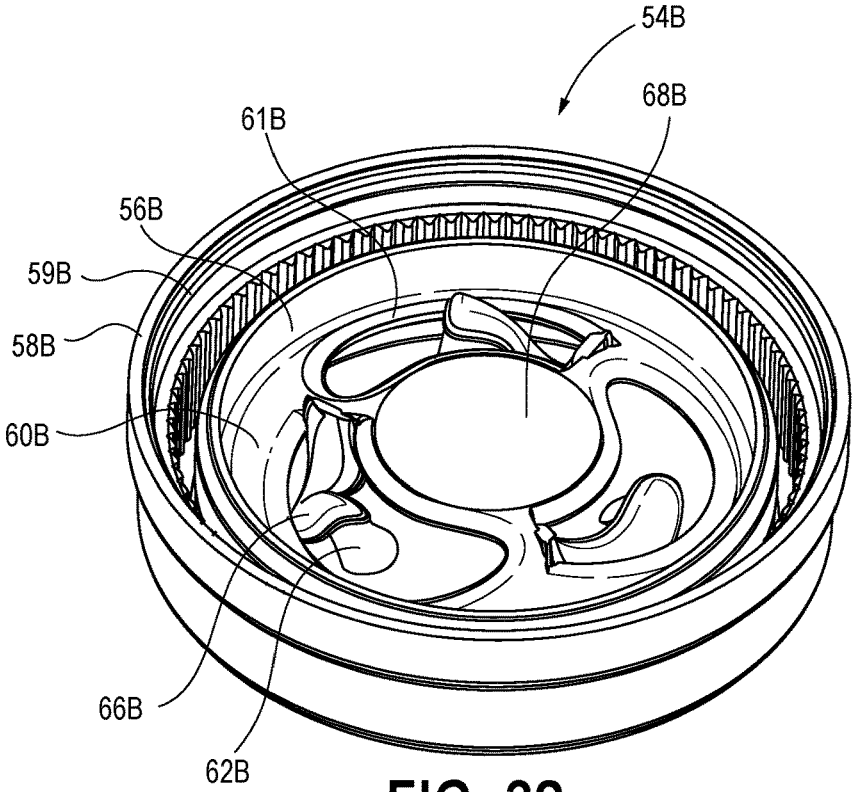
FIG. 32 is an isometric view, taken from below, of the first body of the closure of FIG. 31 showing the breached membrane.
Figure 33:
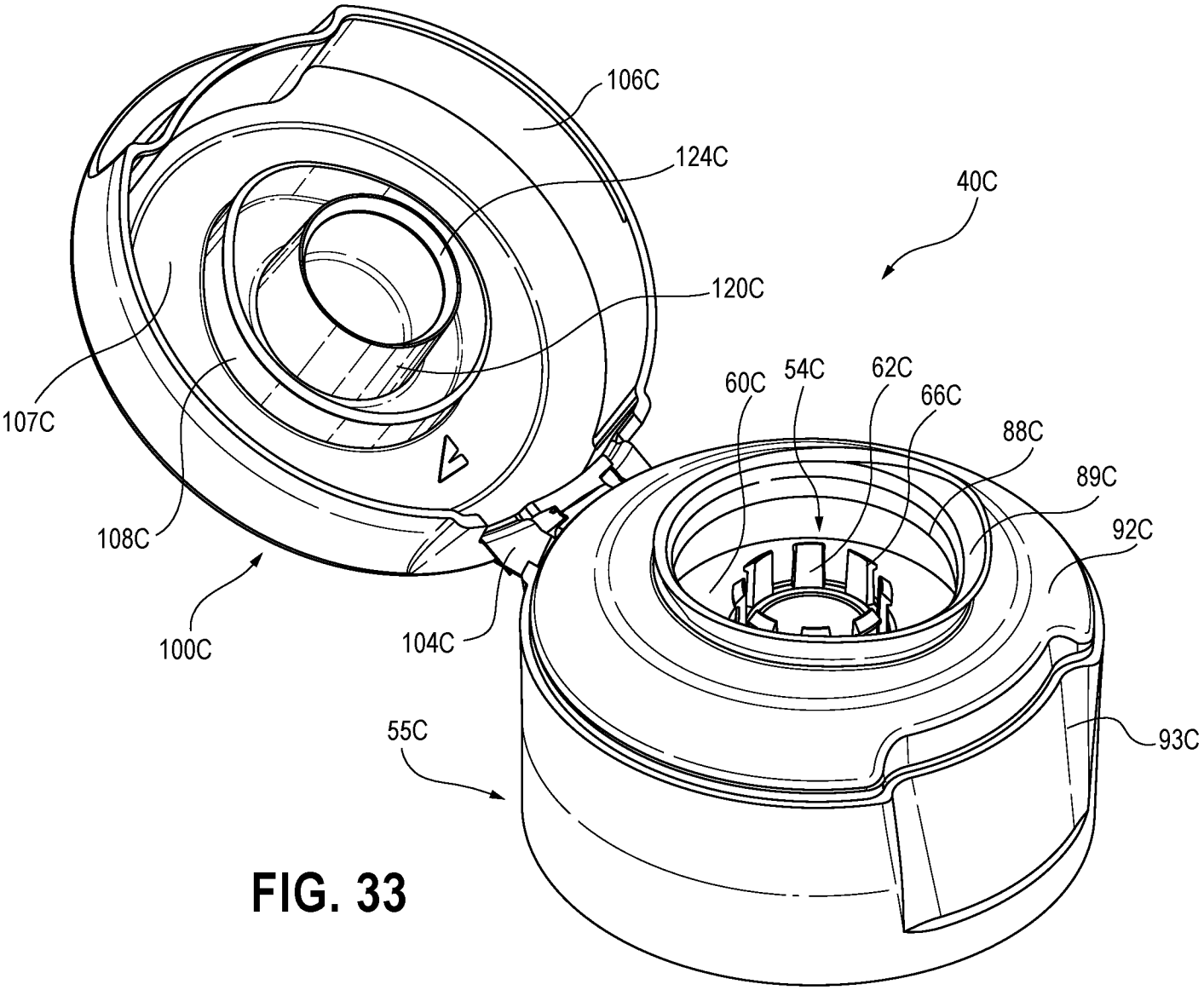
FIG. 33 is an isometric view, taken from above, of a fourth embodiment of a dispensing closure according to the present invention.
Figure 34:
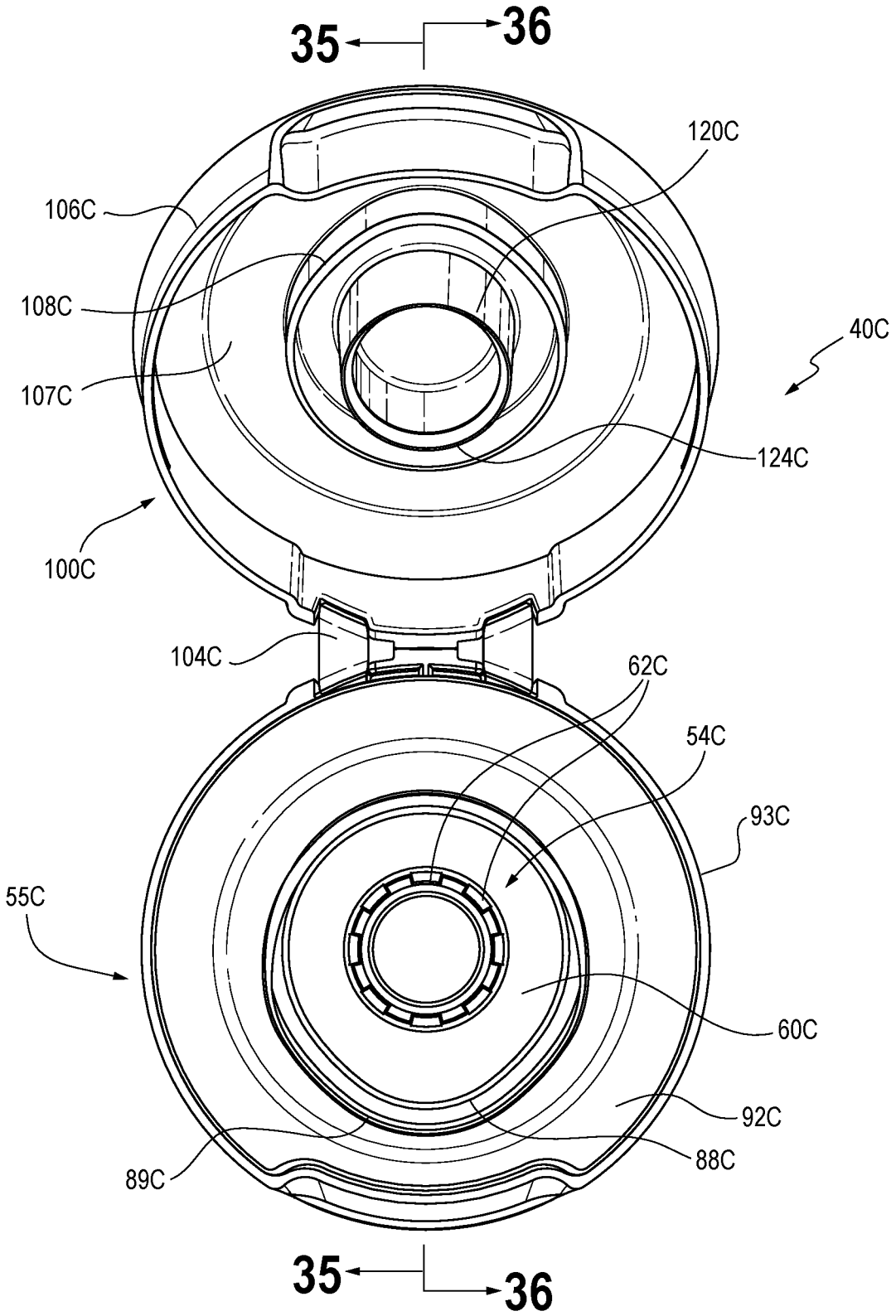
FIG. 34 is a top plan view of the dispensing closure of FIG. 33.
Figure 35:
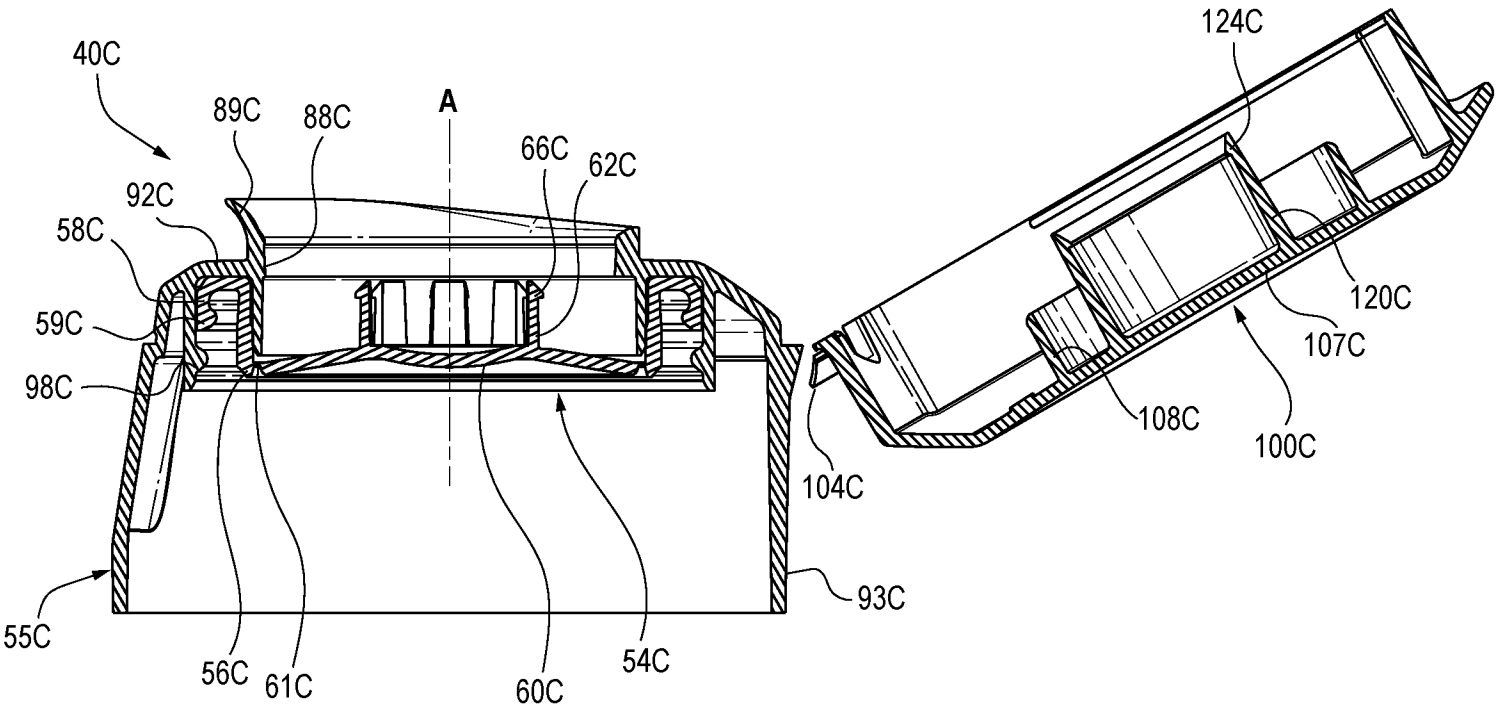
FIG. 35 is a cross-sectional view of the dispensing closure of FIG. 33, taken along view plane 35-35 in FIG. 34.

With reference to FIGS. 28 and 31, the continued relative rotation of the first body 54B and the second body 55B, driving the posts 62B against the abutments 110B, tears or breaches the connections 61B (FIG. 31) of the frangible sections 66B to force the posts 62B and frangible sections 66B downwardly toward the interior of the container to expose the interior of the container 44B. The frangible sections 66B advantageously remain connected to the remainder of the membrane 60B and are supported by a non-frangible, central portion 68B. The permitted angular travel of the second body 55B relative to the first body 54B may be configured depending based on the application, and may be limited by positive stops on the first body 54B and the second body 55B.

The arrangement of the first body 54B and the second body 55B advantageously provides a clear tamper evidence indication to a user of the closure 40B.

The inventors have found that the above-discussed embodiments of the closure 40, 40A, 40B may have several advantages over closures for foil lined packages and removable membrane closures of the prior art. The entire package upon which the closure 40, 40A, 40B is installed may be recycled without any separately discarded component. The fitment or first body 54, 54A, 54B can be sized to fit a wide variety of different orifice sizes, and is not constrained by the minimum diameter for accommodating a finger-sized pull ring that would be required for a removable membrane closure. The actuation forces and methods for breaching the membrane 60, 60A, 60B are designed to be more suitable for an ageing population that may struggle with pull ring removal and/or foil liner removal. The breached membrane 60, 60A, 60B indicates whether or not the package has been opened previously, allows for sufficient product flow, allows for fluent substance to drain back into the container 44, 44A, 44B after dispensing, and does not affect the external aesthetic of the closure 40, 40A, 40B.

Furthermore, the closures 40, 40A do not require any specific rotational orientation between the first body 54, 54A, the second body 55, 55A, and/or the container 44, 44A. Advantageously, the push or press to open engagement by a user of the closures 40, 40A is intuitive to consumers, especially with clear opening indicia or instructions on the push portion 94 of the closure 40 or the push portion 62A of the closure 40A.

With respect to the closure 40B, the product may be accessed without opening of the closure lid 100B, which may prevent splashing or contamination of the dispensing orifice 88B when breaching the membrane 60B.

A fourth embodiment of a closure 40C according to the present invention is illustrated in FIGS. 33-42, which has a substantially modified configuration of the first body 54C and the second body 55C that may present the user with a different mode of actuating the closure 40C, as compared to the first illustrated embodiment of the closure 40. Like elements between the first illustrated embodiment of the closure 40 and the fourth illustrated embodiment of the closure 40C are designated with the same numeral (the first embodiment numbered features having no suffix and the fourth embodiment having numbered features with a "C" suffix). The fourth illustrated embodiment of the closure 40C has the same basic elements as the first illustrated embodiment of the closure 40, namely a fitment or first body 54C for being installed within the opening of a container 44C and an overclosure or second body 55C covering the first body 54C.

Figure 37:
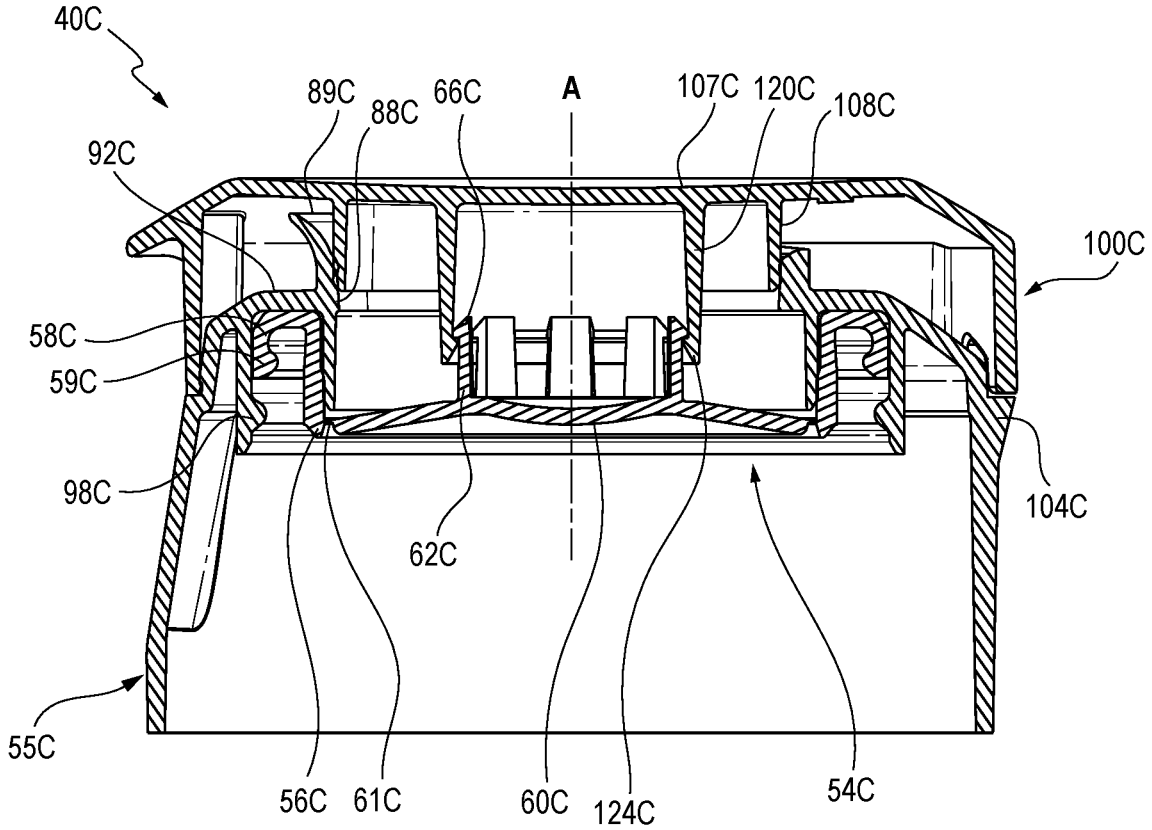
FIG. 37 is a cross-sectional view of the dispensing closure shown in FIG. 35.
Figure 38:
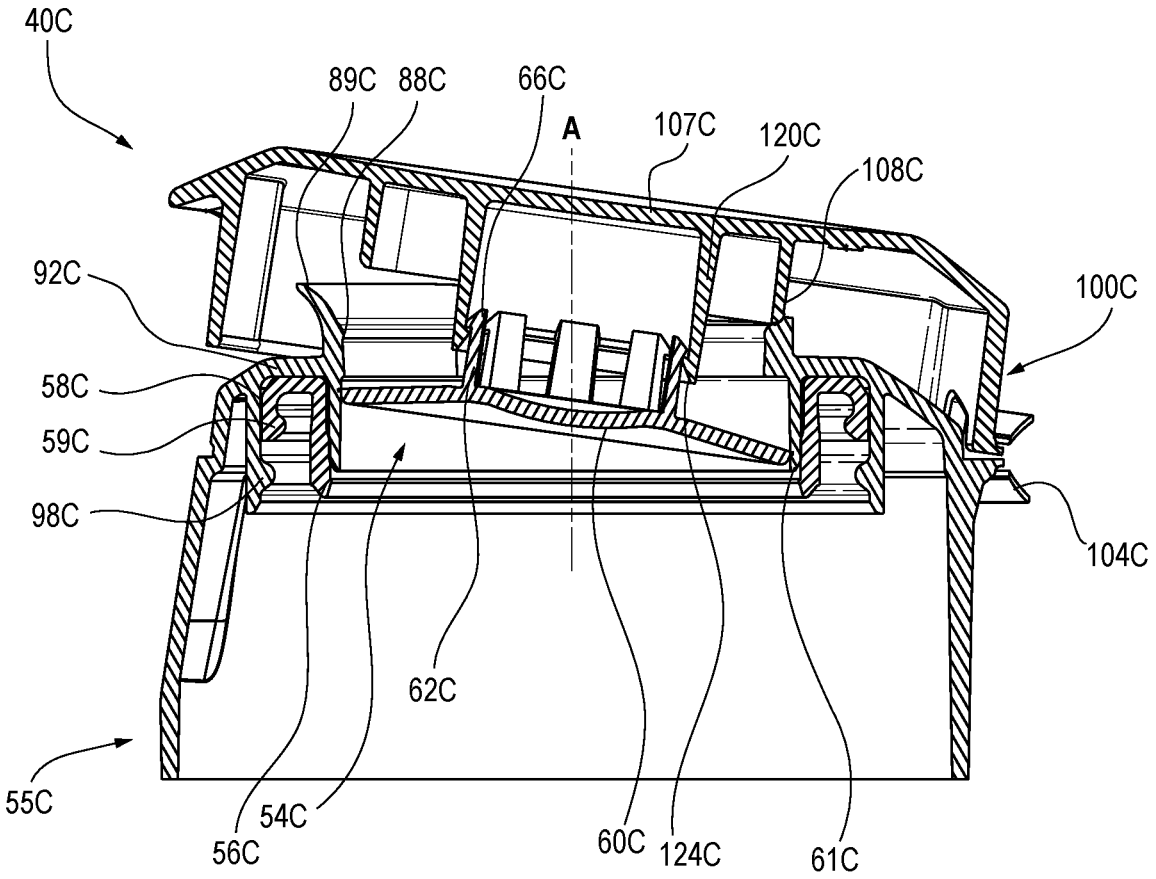
FIG. 38 is a cross-sectional view of the dispensing closure shown in FIG. 37.
Figure 39:
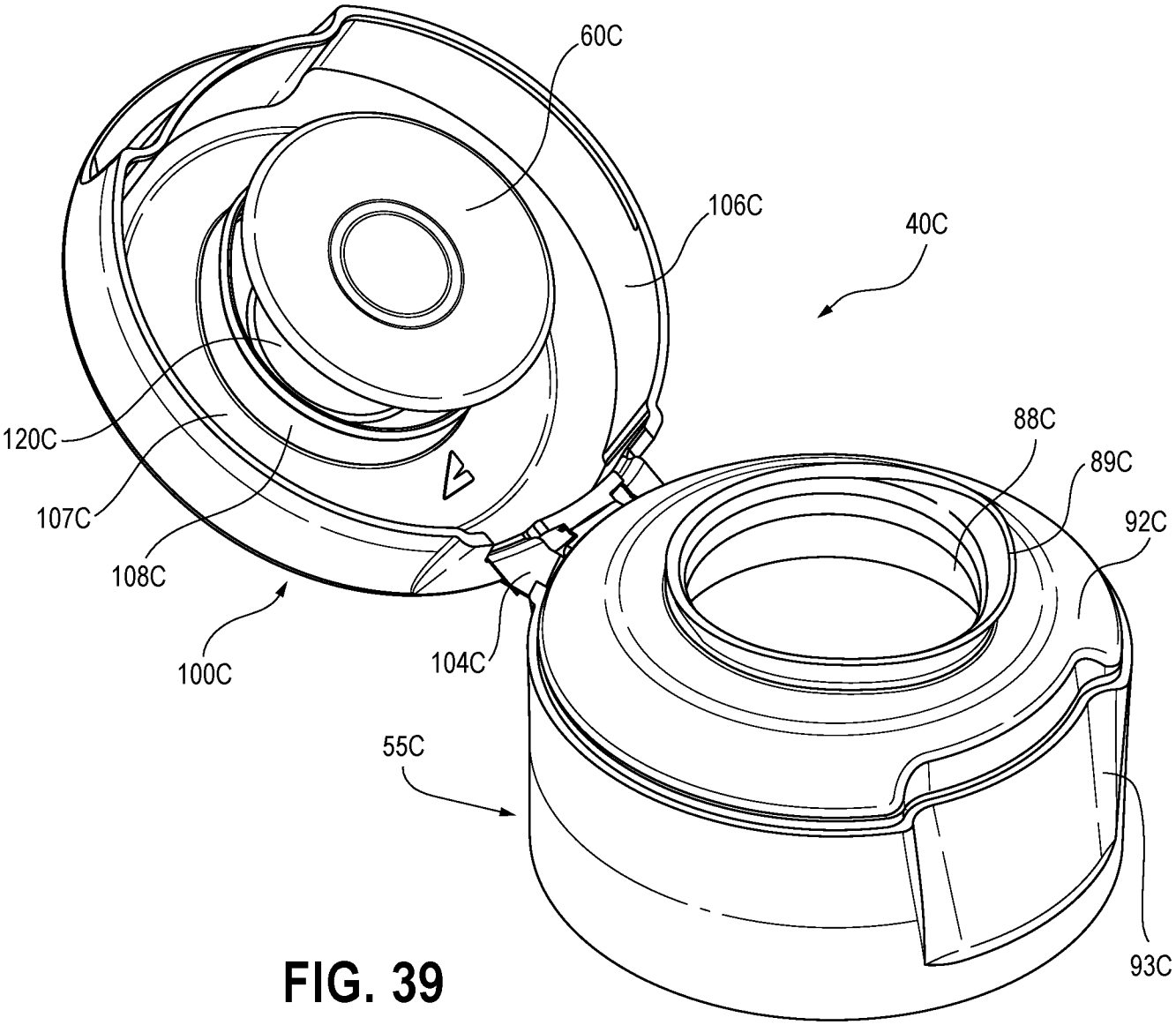
FIG. 39 is an isometric view, taken from above, of the dispensing closure of FIG. 38.
Figure 41:
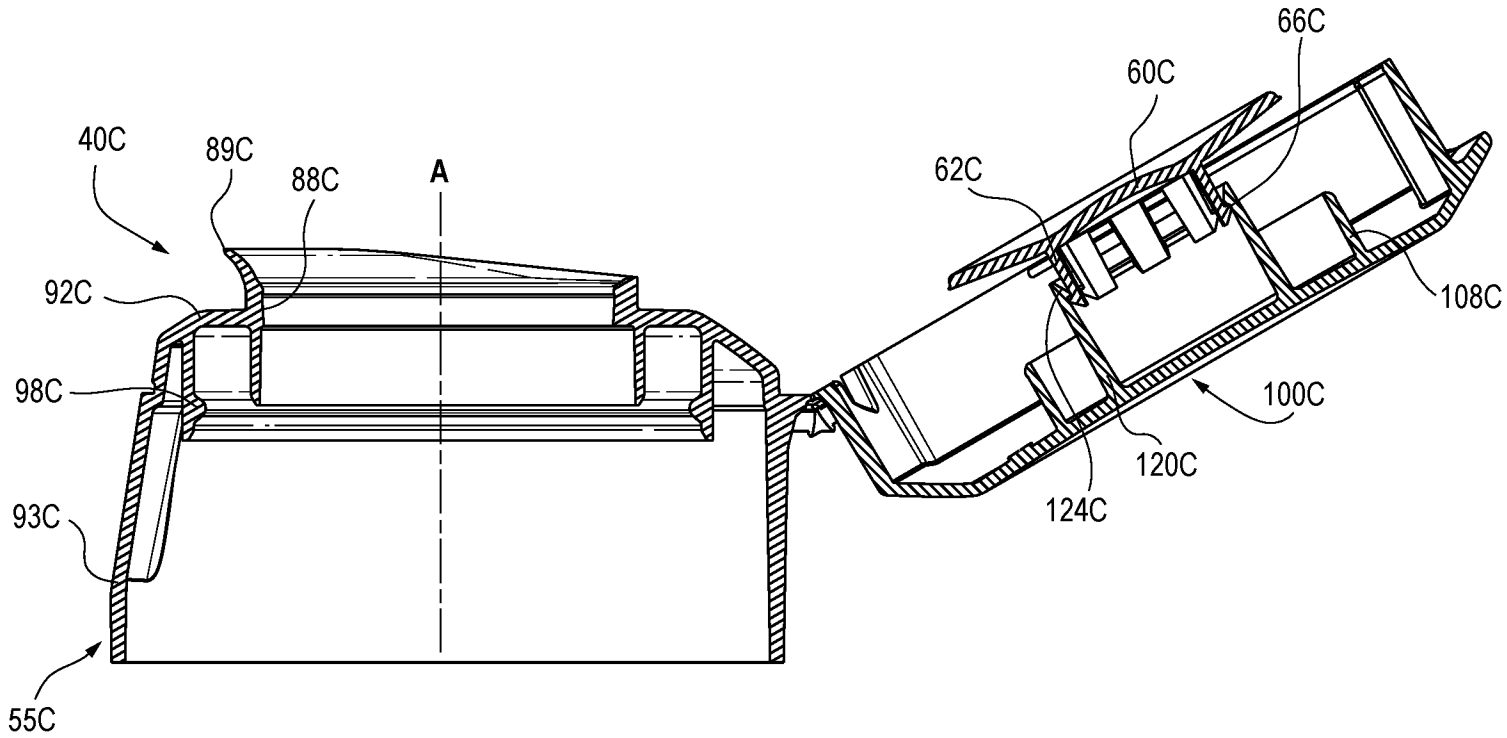
FIG. 41 is a cross-sectional view of the dispensing closure of FIG. 40, taken along view plane 41-41 in FIG. 40.
Figure 42:
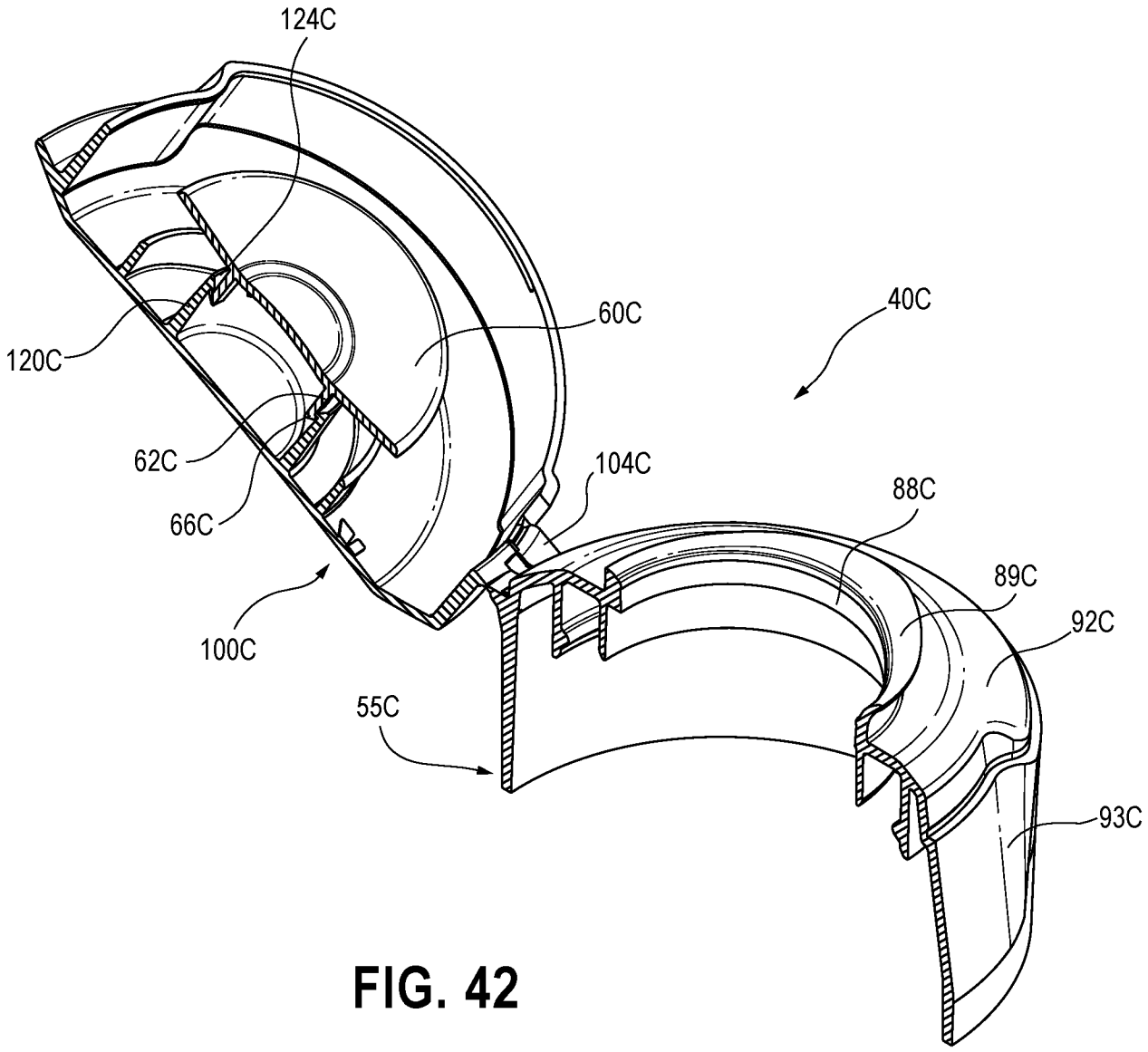
FIG. 42 is an isometric, cross-sectional view of the dispensing closure of FIG. 40, taken along view plane 42-42 in FIG. 40.

Referring now to FIGS. 37, 38, and 41, the fourth illustrated embodiment of the closure 40C differs from the first illustrated embodiment of the closure 40 in that the closure 40C is initially actuated (such that the membrane 60C is breached) by initial opening of the lid 100C such that the membrane 60C is broken or torn from the first body 54C to remain with the lid 100C of the second body 55C. It will be understood that while the lid 100C is rotatably connected with the top deck 92C of the second body 54C by a hinge 104C, the lid 100C may be attached by screw threads, a tether, or other removable means.

Figure 40:
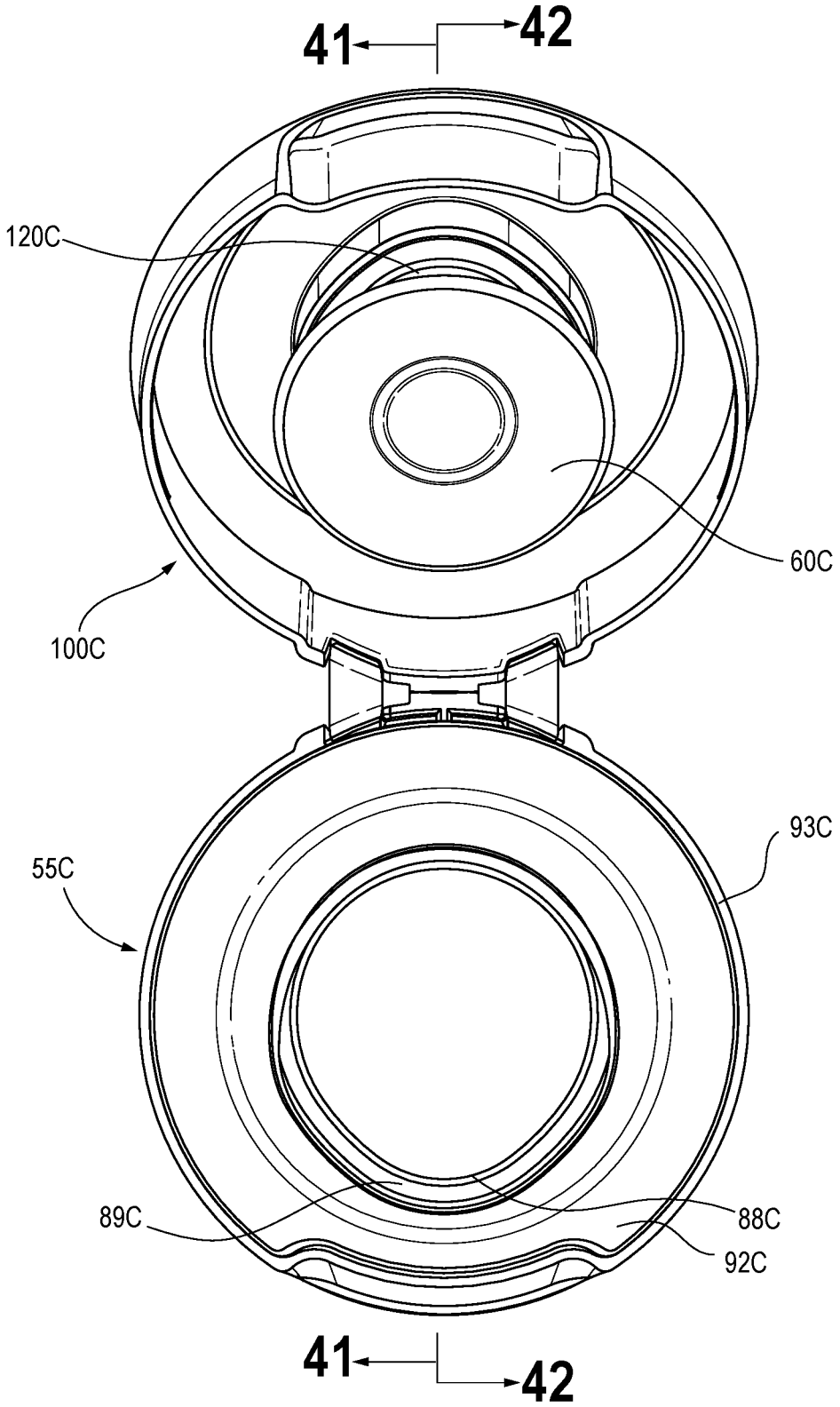
FIG. 40 is a top plan view of the dispensing closure of FIG. 39.

The membrane 60C includes a plurality of axially-upwardly extending ribs 62C, each one of which includes a radially-outwardly extending flange 66C for engaging a mating structure or structures on the lid 100C. Specifically, the lid 100C includes an internal wall 120C, located inwardly of the sealing plug wall 108C, and extending axially inwardly or downwardly from the top end 107C. The internal wall 120C includes a radially-inwardly extending bead or flange 124C for engaging the flanges 66C of the ribs 62C. The engagement force of the mating flanges 66C and 124C is sufficiently strong enough to ensure that the connection 61C of the membrane 60C with the remainder of the first body 54C fails or tears before disengagement of the flanges 66C and 124C can occur. Accordingly, a user's rotation of the lid 100C relative to the top deck 92C of the second body 55C has the effect of breaking the connection 61C to permit the removal of the membrane 60C from the remainder of the first body 54C to expose the dispensing orifice 88C (FIG. 40). Importantly, the membrane 60C remains with the lid 100C of the opened closure 40C to eliminate additional waste that would need to be discarded separately by a user. While the membrane 60C is provided with a plurality of ribs 62C, it will be understood that in some applications (not illustrated) the membrane 60C may have just a single rib 62C extending therefrom. Likewise, it will be understood that in some applications (not illustrated) the lid 100C may have a plurality of internal walls 120C extending downwardly therefrom to engage one or more ribs 62C of the membrane 60C.

Figure 36:
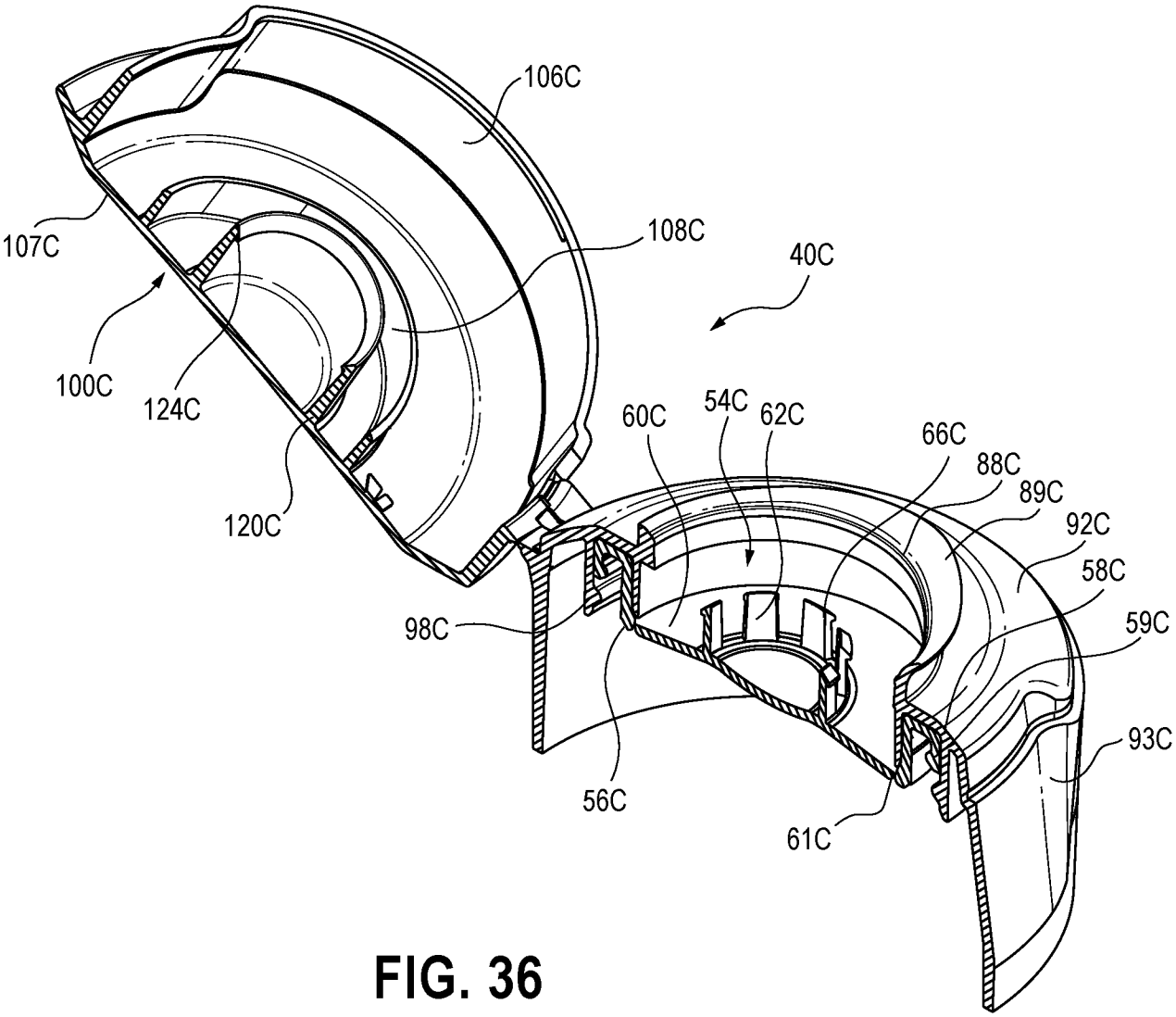
FIG. 36 is an isometric cross-sectional view of the dispensing closure of FIG. 33, taken along view plane 36-36 in FIG. 34.

With reference to FIG. 36, it can be seen that the connection 61C separating the membrane 60C from the annular, plug wall or first peripheral wall 56C is circular, whereby the separated membrane 60C has a disc-like shape upon full separation from the rest of the first body 54C. In other forms of the present invention (not illustrated), the frangible connection may have a boat shape to permit directional pouring through the dispending orifice 88C upon opening of the lid 100C, or the frangible connection may have a series of arcuate flower-shaped undulations that would allow for tearing to be initiated from many different orientations to lower tear initiation force.

The presence of the membrane 60C on the underside of the lid 100C advantageously provides a clear tamper evidence indication to a user of the closure 40C.

Other configurations of the present invention are set forth in the claims.

Various modifications and alterations to this invention will become apparent to those skilled in the art without departing from the scope and spirit of this invention. Illustrative embodiments and examples of the system are provided as examples only and are not intended to limit the scope of the present invention.

What is claimed is:

1. A dispensing closure for use in dispensing a substance that may be stored within an interior of a container, said dispensing closure comprising:

a first body for being located at an opening of a container, said first body having a first peripheral wall and a membrane that is integrally molded with said first peripheral wall to initially occlude access to the interior of the container;

a second body for surrounding at least a portion of said first body and defining a dispensing orifice; and wherein said first body and/or said second body includes means for accommodating engagement by a user to breach only a portion of said membrane in a direction toward the interior of the container to permit access to the interior of the container.

2. The dispensing closure according to claim 1 wherein said means includes a push portion connected to said membrane, said first body including at least one piercing rib extending from said first peripheral wall, whereby a pushing engagement of said push portion by a user forces said membrane against said at least one piercing rib to breach only a portion of said membrane adjacent said at least one piercing rib.

3. The dispensing closure according to claim 2 wherein said first body includes a plurality of piercing ribs.

4. The dispensing closure according to claim 2 wherein said second body includes a pour lip extending laterally and axially outwardly around said dispensing orifice, and said push portion is laterally adjacent said pour lip.

5. The dispensing closure according to claim 2 wherein said push portion is located within said dispensing orifice of said second body.

6. The dispensing closure according to claim 2 wherein said at least one piercing rib terminates in a pointed end that is located axially outwardly of said first peripheral wall.

7. The dispensing closure according to claim 1 wherein said means includes a push portion rotatably connected to said second body, said push portion defining a cantilevered end located above said membrane proximate to said first peripheral wall.

8. The dispensing closure according to claim 7 wherein said dispensing closure defines a central axis extending outwardly away from an interior of the container and extending inwardly toward an interior of the container, said second body includes a pour lip extending laterally and axially outwardly around said dispensing orifice, and said push portion is located axially inwardly of said pour lip.

9. The dispensing closure according to claim 7 wherein said push portion is located within said dispensing orifice of said second body.

10. The dispensing closure according to claim 7 wherein said dispensing closure defines a central axis extending outwardly away from an interior of the container and extending inwardly toward an interior of the container, said push portion is connected to a transverse wall of the second body by a hinge, and said push portion extends axially outwardly of said transverse wall.

11. The dispensing closure according to claim 7 wherein said push portion includes at least one rib facing said membrane and located laterally between said cantilevered end and said hinge.

12. The dispensing closure according to claim 7 wherein said dispensing closure defines a central axis extending outwardly away from an interior of the container and extending inwardly toward an interior of the container, and wherein said membrane includes an annular peripheral portion which slopes axially outwardly along said central axis and said membrane includes a concave central portion that slopes axially inwardly from said annular peripheral portion toward said central axis.

13. The dispensing closure according to claim 1 wherein said means includes at least one projecting post connected to said membrane and at least one abutment connected to said second body, whereby relative rotation between said first body and said second body forces said at least one projecting post against said at least one abutment to breach only a portion of said membrane in a direction toward the interior of the container.

14. The dispensing closure according to claim 13 wherein said dispensing closure defines a central axis extending outwardly away from an interior of the container and extending inwardly toward an interior of the container, and said at least one projecting post has a V-shaped cross-section in a plane perpendicular to said central axis.

15. The dispensing closure according to claim 13 wherein said membrane includes a plurality of projecting posts and said second body includes a plurality of abutments.

16. The dispensing closure according to claim 13 wherein said at least one projecting post connects to an arcuate frangible section of said membrane.

17. The dispensing closure according to claim 13 wherein said membrane includes a non-frangible central portion.

18. The dispensing closure according to claim 1 wherein said first body further includes a second peripheral wall connected to, and surrounding, said first peripheral wall, said first and second peripheral walls for receiving a portion of the container to secure said first body at the opening of the container.

19. The dispensing closure according to claim 1 wherein said second body includes a top deck and a skirt extending downwardly from said top deck for surrounding a portion of the container, said second body including a lid rotatably connected to said top deck.

20. The dispensing closure according to claim 1 wherein said second body includes means for being non-removably secured with said first body at an opening of the container.

21. The dispensing closure according to claim 1 in combination with container of a fluent substance, said dispensing closure, container, and fluent substance together defining a package.

22. A dispensing closure for use in dispensing a substance that may be stored within an interior of a container, said dispensing closure comprising:

a first body for being located at an opening of a container, said first body having a first peripheral wall and a membrane that is integrally molded with said first peripheral wall to initially occlude access to the interior of the container;

a second body for surrounding at least a portion of said first body and defining a dispensing orifice, said second body including a lid movably connected thereto, wherein said membrane and said lid include engagement means whereby initial opening of said lid by a user separates said membrane from said first body and said membrane is retained in said lid.

23. The dispensing closure according to claim 1 wherein said first body and said second body comprise a sub-assembly with said first body loosely retained within a bottom of said second body for being installed at the opening of the container.

* * * * *